US007971631B2

(12) United States Patent
Alcaine et al.

(10) Patent No.: US 7,971,631 B2
(45) Date of Patent: Jul. 5, 2011

(54) HEAT EXCHANGER UNIT FOR MOTOR VEHICLES

(75) Inventors: Manuel Alcaine, Stuttgart (DE); Klaus Hassdenteufel, Gerlingen (DE); Markus Höglinger, Stuttgart (DE); Wolfgang Reier, Schwaikheim (DE); Rainer Ruoff, Erdmannhausen (DE); Michael Spieth, Gomaringen (DE)

(73) Assignee: Behr GmbH & Co. KG, Stuttgart (DE)

( * ) Notice: Subject to any disclaimer, the term of this patent is extended or adjusted under 35 U.S.C. 154(b) by 1067 days.

(21) Appl. No.: 10/556,922

(22) PCT Filed: Apr. 1, 2004

(86) PCT No.: PCT/EP2004/003471

§ 371 (c)(1),
(2), (4) Date: Feb. 12, 2007

(87) PCT Pub. No.: WO2004/102098

PCT Pub. Date: Nov. 25, 2004

(65) Prior Publication Data

US 2007/0272175 A1 Nov. 29, 2007

(30) Foreign Application Priority Data

May 13, 2003 (DE) ..... 103 21 458

(51) Int. Cl.
*B60H 1/00* (2006.01)

(52) U.S. Cl. ..... 165/41; 165/140; 165/152; 165/153; 29/890.03

(58) Field of Classification Search ..... 165/41, 165/140, 152, 153; 29/890.03
See application file for complete search history.

(56) References Cited

U.S. PATENT DOCUMENTS

| | | | | |
|---|---|---|---|---|
| 5,033,540 | A * | 7/1991 | Tategami et al. | 165/41 |
| 5,129,144 | A | 7/1992 | Halstead et al. | |
| 5,348,081 | A * | 9/1994 | Halstead et al. | 165/153 |
| 5,509,199 | A * | 4/1996 | Beamer et al. | 29/890.03 |
| 5,657,817 | A * | 8/1997 | Heine et al. | 165/140 |
| 6,012,512 | A | 1/2000 | Ghiani | |
| 6,095,239 | A * | 8/2000 | Makino et al. | 165/140 |
| 6,170,569 | B1 * | 1/2001 | Dienhart et al. | 165/153 |
| 6,189,603 | B1 | 2/2001 | Sugimoto et al. | |
| 6,267,174 | B1 * | 7/2001 | Ozaki et al. | 165/140 |
| 6,305,465 | B1 | 10/2001 | Uchikawa et al. | |
| 6,533,027 | B2 * | 3/2003 | Gille et al. | 165/140 |
| 6,561,264 | B2 * | 5/2003 | Ozaki et al. | 165/140 |
| 6,615,604 | B2 * | 9/2003 | Neufang | 165/140 |
| 6,964,296 | B2 * | 11/2005 | Memory et al. | 165/152 |
| 7,243,710 | B2 * | 7/2007 | Shinhama | 165/140 |

FOREIGN PATENT DOCUMENTS

| | | |
|---|---|---|
| DE | 199 61 199 A1 | 6/2001 |
| EP | 1 191 298 A2 | 3/2002 |

* cited by examiner

*Primary Examiner* — Ljiljana V Ciric
(74) *Attorney, Agent, or Firm* — Greer, Burns & Crain, Ltd.

(57) ABSTRACT

A heat exchanger unit for motor vehicles includes one first heat exchanger and one second heat exchanger. Each heat exchanger includes two collector pipes which are arranged at a distance from each other. One collector pipe of the first heat exchanger is arranged substantially adjacent to one collector pipe of the second heat exchanger. Also, the other collector pipe of the first heat exchanger is arranged substantially adjacent to the other collector pipe of the second heat exchanger.

22 Claims, 14 Drawing Sheets

HEAT EXCHANGER UNIT FOR MOTOR VEHICLES

BACKGROUND

The present invention relates to a heat exchanger unit for motor vehicles. Heat exchanger units for motor vehicles are known. They are used in automotive engineering as, for example, cooling devices for the motor or internal combustion engine, or as an air conditioner condenser for an air conditioning system of a motor vehicle. It is also known to equip motor vehicles with a radiator only, without providing an air conditioning condenser. It is also known to couple a radiator and an air conditioning condenser to form an assembly. Heat exchangers coupled in this way have, as do radiators and air conditioning condensers fashioned separately, collector pipes situated at a distance from one another, between which there is provided a system of cooling fins and pipes. Given a design in which two heat exchangers are coupled to form a constructive unit, two such collector pipes are assigned to each of these heat exchangers. In the known designs, having a separate construction or a construction with a coupled module, these pipes each have cylindrical covering walls.

The underlying object of the present invention is to create an operationally reliable heat exchanger unit that can be manufactured easily from the point of view of production engineering, and that can be constructed so as to save space and weight.

SUMMARY OF THE INVENTION

In particular, according to the present invention a heat exchanger unit for motor vehicles is provided that has a first heat exchanger and a second heat exchanger. Each of these heat exchangers has two collector pipes situated at a distance from one another. A collector pipe of the first heat exchanger is situated essentially adjacent to a collector pipe of the second heat exchanger, and another collector pipe of the first heat exchanger is situated essentially adjacent to another collector pipe of the second heat exchanger. The two collector pipes of the first heat exchanger are connected to one another in terms of flow, and the two collector pipes of the second heat exchanger are connected to one another in terms of flow.

A cross-section, situated or regarded as perpendicular to the longitudinal axis of a collector pipe of the first heat exchanger, of the covering wall of this collector pipe is non-circular in shape, or all such cross-sections are non-circular.

In addition, the object of the invention is in particular achieved by a heat exchanger unit having a first heat exchanger as well as a second heat exchanger, each of these heat exchangers having two collector pipes situated at a distance from one another. In this embodiment, each collector pipe of the first heat exchanger is situated essentially adjacent to a collector pipe of the second heat exchanger, and another collector pipe of the first heat exchanger is situated essentially adjacent to another pipe of the second heat exchanger. In addition, in this embodiment the two collector pipes of the first heat exchanger are connected to one another in terms of flow. The two collector pipes of the second heat exchanger are also connected to one another in terms of flow in this embodiment. In this embodiment, it is provided that a cross-section of one collector pipe of the first heat exchanger and/or of the second heat exchanger is essentially oval or (annularly) elliptical, this cross-section being situated or regarded essentially perpendicular to the longitudinal axis of the relevant collector pipe. This can apply to all cross-sections of this type; in any case it is preferred (and this holds for all embodiments of the present invention) that the collector pipes have cross-sections at the various positions of their longitudinal direction that are essentially identical in shape, perpendicular to this longitudinal direction. Any profilings that may be present on the surfaces of the covering wall, and/or beads and/or aids for introducing pipes or collars and/or passages for receiving such pipes or collars, are preferably not regarded as deviations that alter the cross-section of the covering wall of a collector pipe.

In addition, according to the present invention a heat exchanger unit for motor vehicles is in particular proposed that has a first heat exchanger as well as a second heat exchanger, each of these heat exchangers having two collector pipes situated at a distance from one another. In this embodiment, each collector pipe of the first heat exchanger is situated essentially adjacent to a collector pipe of the second heat exchanger, and the other collector pipe of the first heat exchanger is essentially adjacent to the other pipe of the second heat exchanger. In addition, in this embodiment the two collector pipes of the first heat exchanger are connected to one another in terms of flow and the two collector pipes of the second heat exchanger are connected to one another in terms of flow. In addition, in this embodiment it is provided that the covering wall of one or both collector pipes of the first heat exchanger and/or of one or both collector pipes of the second heat exchanger—in the cross-section regarded or situated perpendicular to the longitudinal axis of the relevant collector pipe, or in all cross-sections of this type—has overlapping wall segments that are preferably connected to one another by a suitable connecting method. Such a suitable connecting method can be, for example, soldering.

In addition, according to the present invention a heat exchanger unit for motor vehicles is in particular provided that has at least one heat exchanger that is in particular a radiator, this heat exchanger having two collector pipes situated at a distance from one another, these collector pipes being connected to one another in terms of flow. In addition, in this embodiment it is provided that a cross-section of one or both of these collector pipes, situated or regarded as perpendicular to the longitudinal axis of this collector pipe, or all cross-sections of this type, is not circular in shape, and has a wall, or a segment of the covering wall, of this collector pipe that is a wall facing the other collector pipe and is designated the base wall, and that has a curved segment or is essentially completely curved.

In preferred embodiments, it is provided that the cross-sectional surfaces discussed above essentially do not change along the longitudinal axis of the relevant collector pipe. However, it can also be provided that such cross-sectional surfaces have various shapes along the mentioned longitudinal axis.

The first heat exchanger is preferably a radiator for cooling the motor of a motor vehicle, and the second heat exchanger is preferably an air conditioner condenser for an air conditioning system of a motor vehicle.

The heat exchanger unit having a first heat exchanger and a second heat exchanger has in particular at least two fluid circuits, namely a fluid circuit of the first heat exchanger and a fluid circuit of the second heat exchanger. It can also be provided that such a heat exchanger is divided into a multiplicity of sub-heat exchangers, each having separate fluid circuits. This can for example be realized such that inside the collector pipes of this heat exchanger corresponding separating walls are provided that are situated in such a way that the fluid circuits are separated.

However, separating walls inside the collector pipes can also be provided for the purpose of conducting fluid in a serpentine manner inside the relevant heat exchanger, in a known manner. A corresponding serpentine routing of the fluid between the collector pipes belonging to the same heat exchanger and the flow connecting devices, here situated intermediately, can be provided in the radiator and/or in the air conditioning condenser.

However, it is preferred that the air conditioning condenser, in particular, be realized as a parallel flow condenser.

However, in principle the radiator can also be fashioned as a parallel flow radiator.

The collector pipes can be constructed in one-piece or multi-piece fashion, in particular with respect to a cross-sectional surface perpendicular to their longitudinal axis. The collector pipes can be provided with covers at their ends. Common covers for adjacent collector pipes can also be provided.

The collector pipes can be constructed for example as sheet metal bent parts or as stamped parts or as extruded profiles. The collector pipes can for example also be manufactured according to an internal high-pressure method. However, other manufacturing methods are also preferred.

Preferably, the first and second heat exchanger are combined to form a constructive unit or assembly. They can also be constructed so as to be separate, and/or capable of being installed separately in a motor vehicle.

In a preferred embodiment, soldered-on connecting elements are provided between the collector pipes. Preferably, such connecting elements are fashioned so as to have a certain spring effect, and can effect a length compensation in case of temperature fluctuations.

Preferably, the collector pipes of different heat exchangers are thermally isolated from one another. For this purpose, for example a corresponding distance can be provided. This can in particular be done in such a way that a thermal isolation is provided.

Collector pipes of different heat exchangers can be situated with respect to one another in such a way that they do not contact one another directly, for example via their covering walls.

Between the collector pipes of each heat exchanger, a heat exchanger block can be provided having a multiplicity of pipes situated in parallel, as well as a multiplicity of cooling fins. Preferably, cooling fins and such pipes are arranged in alternating fashion. It can also for example be provided that a plurality of pipes is situated between cooling fins. Such pipes open in particular into collector pipes assigned to the same two heat exchangers.

As stated above, the unit made up of collector pipes and pipes, or cooling pipes, or connecting pipes, can be constructed in such a way that a parallel flow is provided, or in such a way that a serpentine flow design is provided. Given a serpentine design, it can in particular be provided that the medium flows in different directions through adjacent pipes situated between the collector pipes. In the case of a parallel flow design, it is in particular provided that medium can flow through these adjacent connecting pipes in the same direction of flow. It can also be provided that medium flows through a group of adjacent pipes in a first direction of flow and flows through a subsequent, second group in the opposite direction of flow.

Such designs can be realized in particular by a corresponding arrangement of separating walls inside the collector pipes.

In a heat exchanger unit having a first heat exchanger and a second heat exchanger, in particular separate connecting pipes are provided. In such designs, common cooling fins can be provided for the different heat exchanger units. These can be in particular continuous cooling fins that can also have thermal isolation. However, common cooling fins can also be provided for the different heat exchangers of the same heat exchanger unit.

Via such common cooling fins, it is for example also possible to produce a connection of these heat exchangers. A connection can for example also be produced via lateral parts that are connected partially or completely with the respective collector pipes and/or with terminating fins. In addition, it can be provided that different heat exchangers of the heat exchanger unit are connected to one another via conventional fastening systems.

In a preferred embodiment, the heat exchanger unit is soldered at various connecting points.

Particularly preferably, it is provided that the heat exchanger unit is made entirely or partly of aluminum. An all-aluminum construction is particularly preferred.

The provision of a thermal separation between heat transfer areas of the various cooling circuits is particularly preferred.

The collector pipes preferably have one-piece or multi-piece sheet metal parts, as well as covers. In addition, collars or connecting collars or attaching parts, such as fastening bolts for installation in a motor vehicle or the like or attaching parts for the fastening of additional heat exchangers or ventilator bodies, can be provided. Such collars or attaching parts can be fastened by suitable connecting techniques. They can for example be soldered on or welded on or clipped on.

In a preferred embodiment, the heat exchanger unit is fashioned in such a way that it can be situated behind the bent contour of what is known as a bumper bracket in a motor vehicle, or a shape integration is possible.

Holes or through-openings or specially shaped passages can be provided on the collector pipes in order to receive the connecting pipes or cooling pipes. In addition, such holes or passages can be provided for receiving side parts or connecting pipes or connecting collars or drainage devices or the like.

Such openings and passages can in particular be provided in the floor surfaces or side surfaces of the collector pipes. Particularly preferably, introduction aids are provided for such cooling pipes or for such collars. They can for example be inclined or curved, in particular formed in the shape of a funnel.

Passages can extend for example in the direction of the inside of the collector pipe or in the direction of its outside. Reinforcements of the covering wall of the collector pipe can be provided, which can for example be situated in the floor area or in the side area. These reinforcements can be for example stamped-in beads.

Preferably, a collector pipe, or both collector pipes, of the first heat exchanger or of the heat exchanger, is limited by a peripheral wall including a base wall, an outer wall, a front wall, and a rear wall. Here, the base wall is the wall of the peripheral wall that faces the other collector pipe of this heat exchanger. The outer wall is the wall of the covering wall that faces away from this other collector pipe of the same heat exchanger. The front wall of the peripheral wall is the wall that faces an adjacent collector pipe of another heat exchanger, and the rear wall is the wall of the covering wall that faces away from this adjacent collector pipe of another heat exchanger.

However, it is to be noted that such walls can also be provided in an embodiment in which both a first and second heat exchanger are not provided. In such embodiments, the front wall is the left (from the point of view of the other collector pipe of the same heat exchanger) connecting wall between the base wall and the outer wall, and the rear wall is the corresponding right connecting wall, or vice versa.

Between such walls of the covering wall, transition areas can be provided or are provided. The transition areas can form a part of the adjoining walls, or can be different from these.

Preferably, such a transition area extends (seen in the direction of the periphery of the covering wall) over less than 15 times, preferably less than 10 times, preferably less than 8 times, preferably less than 5 times, preferably less than 4 times, preferably less than 3 times, preferably less than 2 times, and preferably less than essentially one time the thickness of this covering wall.

In addition, it is preferable that such walls of the covering wall, or the covering wall segments, have pipe receptacle openings or through-openings.

Preferably, at least one wall segment, or a wall of the covering wall of a collector pipe or of the collector pipes of the first heat exchanger, is concavely curved, regarded in the cross-section situated perpendicular to the longitudinal axis of this collector pipe.

Particularly preferably, at least one wall or a wall segment of the covering wall of a collector pipe of the first heat exchanger is convexly curved, also in relation to a cross-section perpendicular to the longitudinal axis of this collector pipe.

The wall can be fashioned so as to be completely convexly curved. Such a wall can be in particular a rear wall or a front wall or an outer wall or a base wall of the covering wall of a collector pipe.

Such a convexly curved wall segment, or such a convexly curved wall, can have a curvature radius that is essentially constant over the entire curved segment. However, it can also be provided that the curvature radii have different values at various points of this curved segment. They can for example increase in monotonic fashion or decrease in monotonic fashion along the curved segment. However, they can also be different along the segment without decreasing or increasing in monotonic fashion.

The same can hold in corresponding fashion for concavely curved wall segments, or concavely curved walls.

In a preferred embodiment, such a convexly curved wall segment, or such a convexly curved wall, can be curved in such a way that the segment length $s_{total}$ of this wall or wall segment is less than $(0.5*x*\pi)$ times the radius of curvature of the wall segment or of this wall. The segment length here is the overall length of the curved segment, measured corresponding to the curvature.

Here x is greater than zero and less than 0.8. Preferably, x is less than 0.7, particularly preferably less than 0.6, particularly preferably less than 0.5. Furthermore, it is preferable that x be greater than 0.1 or greater than 0.2 or greater than 0.3.

In the sense of the present description, the curvature radius has a finite value. Preferably, the curvature radius is less than 1 meter, preferably less than 0.5 meters, particularly preferably less than 25 cm. The curvature radius can for example also be less than 20 cm or less than 15 cm or less than 10 cm [or] less than 8 cm or less than 5 cm or less than 3 cm.

Such values for the curvature radius are not intended to limit the present invention.

Particularly preferably, the curvature radius is greater than 0.5 cm, particularly preferably greater than 1 cm, particularly preferably greater than 2 cm, particularly preferably greater than 3 cm.

The present invention is also not intended to be limited to these values.

In a preferred embodiment, a convexly curved wall segment or a convexly curved wall is curved in such a way that various curvature radii are present along the segment length, the segment length being less than $(0.5*x*\pi)$ times the minimum curvature radius of these curvature radii, x being greater than zero and less than 0.8, and where x and R can be for example as described above.

In addition, it is preferred that the convexly curved wall segment or the convexly curved wall is curved in such a way that various curvature radii are present along the length or segment length, the segment length being less than $(0.5*x*\pi)$ times the mean curvature radius $R_{mean}$ of this segment or wall segment or wall. Here x is greater than zero and less than 0.8, and can for example assume the values named above. The curvature radius, or mean curvature radius, can also for example assume the above-named values.

In this embodiment, it is preferably provided that the mean curvature radius corresponds to the quotient of an integral and the segment length, or overall length, of this curved segment or of the curved wall segment or of the curved wall. Here the integral is an integral of $(s*R(s))ds$ in the interval limits, and $s=0$ and $s=s_{total}$. Thus, this means that s runs between the beginning of the curved wall segment and the end. Here R(s) is the respective curvature radius at a point s, i.e., along the curved segment.

These prescribed relations between the (segment) length and the minimum or mean or constant curvature radius can preferably relate to curved areas that are continuously only convex or continuously only concave.

In a preferred embodiment, the front wall and/or the base wall has such a curved wall segment, or are fashioned as such a curved wall segment or curved wall.

It can also be provided, in particular in the previously cited embodiment, that an outer wall and a rear wall of the first heat exchanger are fashioned essentially flat and are situated respectively parallel and perpendicular to the cross-section perpendicular to the longitudinal axis of the collector pipe. Here the rear wall and the outer wall can for example be perpendicular to one another, rounded-off transition areas or the like being provided if necessary. Particularly preferably, it is provided that the rear wall is oriented essentially parallel to the (coolant) pipes; i.e., to the connecting pipes between the collector pipes.

It is to be noted that the connection in terms of flow discussed in the context of this application between collector pipes can be produced in particular via such pipes, or coolant pipes.

In a preferred embodiment, the covering wall of a collector pipe of the first heat exchanger has wall segments that are adjacent and that are each flat, or that have a straight cross-section, and that enclose an angle with each other that is between 95° and 185°. Such an angle is preferably between 100° and 170°, particularly preferably between 110° and 160°, particularly preferably between 120° and 150°. It is to be noted here that whenever, in the context of this description, cross-sectional shapes or shapes of the covering wall of a collector pipe are discussed, cross-sectional shapes are in particular meant that are present in a cross-section that is perpendicular to the longitudinal axis of the collector pipe, relating in particular to the shape of the covering wall.

The discussed angle between flat wall segments can in particular also be present in one wall, such as for example within a front wall or within a rear wall or within a base wall or within an outer wall. Such angles can also be present between adjacent walls from the group of walls comprising the front wall, the base wall, the rear wall, or the outer wall.

Preferably, the heat exchanger unit is a two-row or multi-row heat exchanger unit.

BRIEF DESCRIPTION OF THE DRAWINGS

In the following, exemplary embodiments according to the present invention are explained on the basis of Figures, which are not intended to limit the present invention. Individual features shown in the Figures or described on the basis of these Figures are also preferred in combination with other features found in this description.

DETAILED DESCRIPTION OF THE PREFERRED EMBODIMENT

Figure 50:
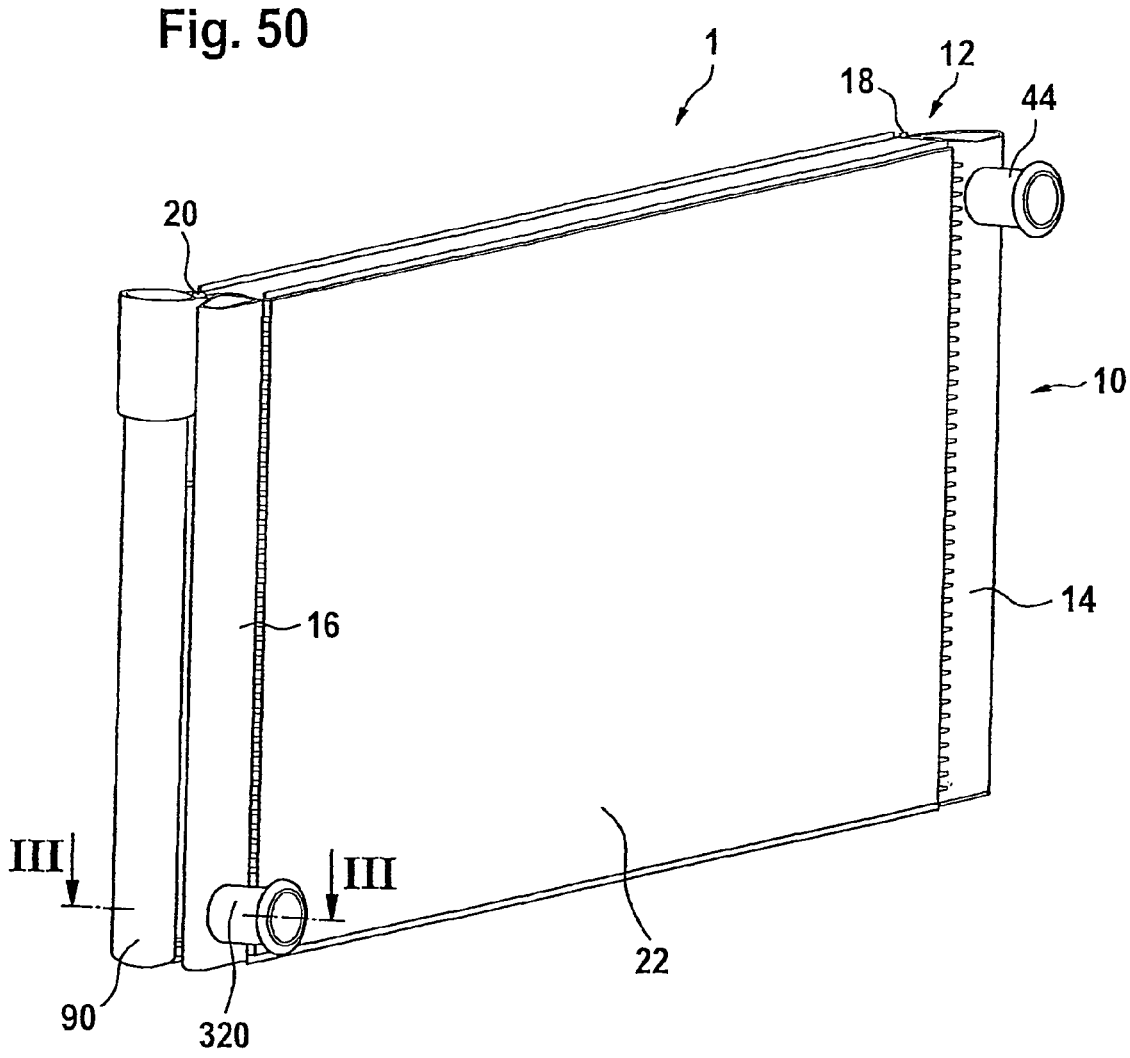
FIG. 50 shows an exemplary specific embodiment of the present invention in a perspective, schematic view.

FIG. 50 shows an exemplary specific embodiment of a heat exchanger unit 1 according to the present invention in a perspective view, having a first heat exchanger 10 and a second heat exchanger 12.

In this embodiment, a heat exchanger block 22 is also provided.

Heat exchanger block 22 has fins and (cooling) pipes. The pipes are situated parallel to one another. A part of these pipes is allocated to first heat exchanger 10, and another part of these pipes is allocated to second heat exchanger 12. Cooling fins can be provided separately for first heat exchanger 10 and second heat exchanger 12; cooling fins can also be provided that are allocated in common to first heat exchanger 10 and to second heat exchanger 12. First heat exchanger 10 and second heat exchanger 12 have fluid circuits that are separate from one another.

In addition, the first heat exchanger, which is for example a radiator for a motor, has a collector pipe 14 and a collector pipe 16 that are situated at a distance from one another and between which heat exchanger block 22 is situated.

Second heat exchanger 12 has a collector pipe 18 and a collector pipe 20 that are also situated at a distance from one another and between which heat exchanger block 22 is situated. In addition, a collector 90 is situated on collector pipe 20. The second heat exchanger is a condenser, such as for example a condenser for an air conditioning system.

Collector pipe 20 is situated adjacent to, and preferably at a distance from, collector pipe 16, and collector pipe 18 is situated adjacent to, and preferably a distance from, collector pipe 14.

In addition, FIG. 50 shows a connecting collar 44 and an additional connecting collar 320. Connecting collars 44 and 320 are used to supply coolant to the first heat exchanger and to carry it away from this heat exchanger.

The cross-sectional surfaces of collector pipes 14 and/or 16 can for example be fashioned in the manner explained on the basis of, and in connection with, FIGS. 4 to 28.

The cross-sectional surfaces of collector pipe 18 and/or collector pipe 20 can for example be fashioned in the manner explained on the basis of, and in connection with, FIGS. 29 to 35.

With reference in particular to collector pipes 14 and 16, transitions between walls of the peripheral wall of these collector pipes 14, 16 can for example be fashioned in the manner explained on the basis of, and in connection with, FIGS. 36 to 44.

Figure 45:
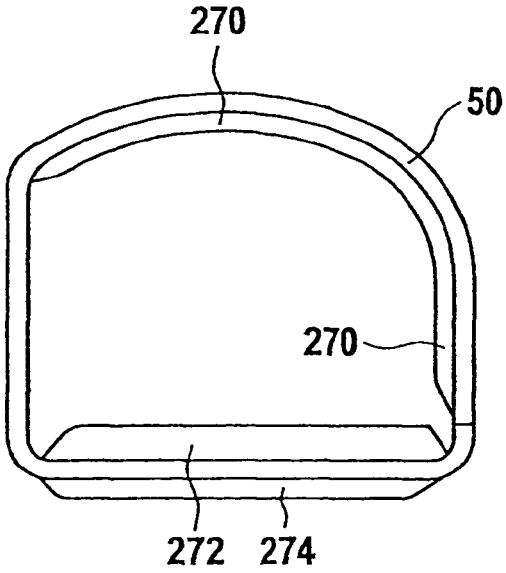
FIG. 45 shows an exemplary embodiment according to the present invention in a schematic partial view.

In addition, beads can be provided in the heat exchanger unit shown in FIG. 50, which are explained in exemplary fashion on the basis of FIG. 45. In addition, openings can be provided that can for example be fashioned in the manner explained on the basis of FIG. 46, as can passages, which can for example be fashioned in the manner explained on the basis of FIGS. 47 to 49.

Collector pipes 14, 16, 18, 20 can also be provided with covers situated at their ends (in the longitudinal direction); these covers are not shown in FIG. 50.

Figure 1:
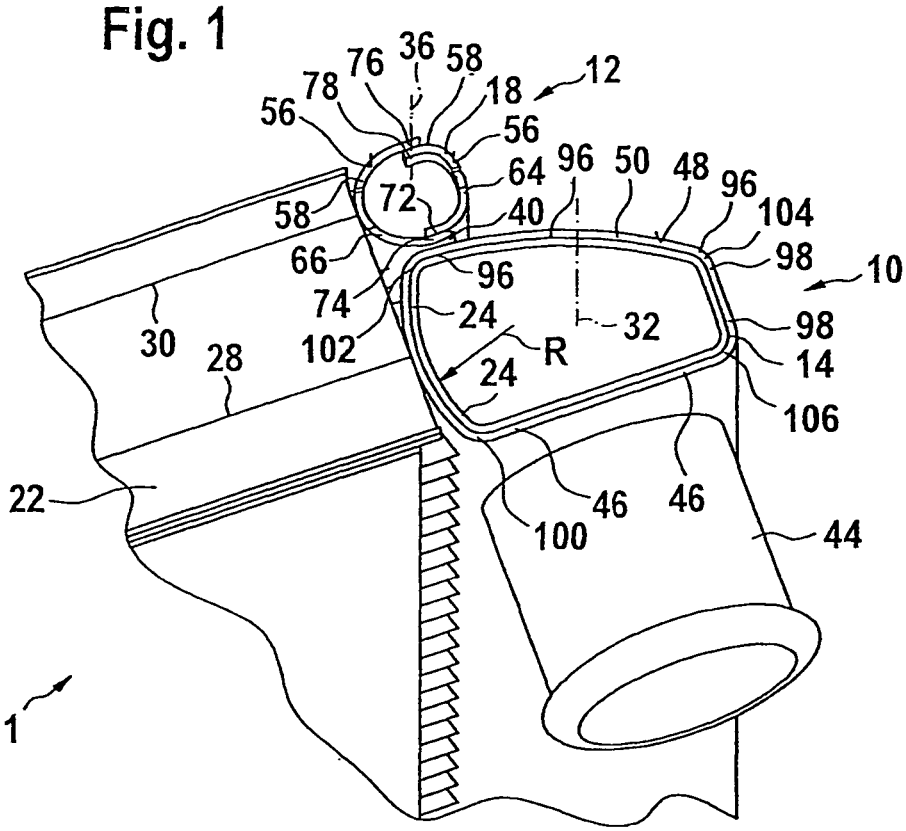
FIG. 1 shows a slightly tilted, enlarged, perspective partial view of the right upper area from FIG. 50.
Figure 2:
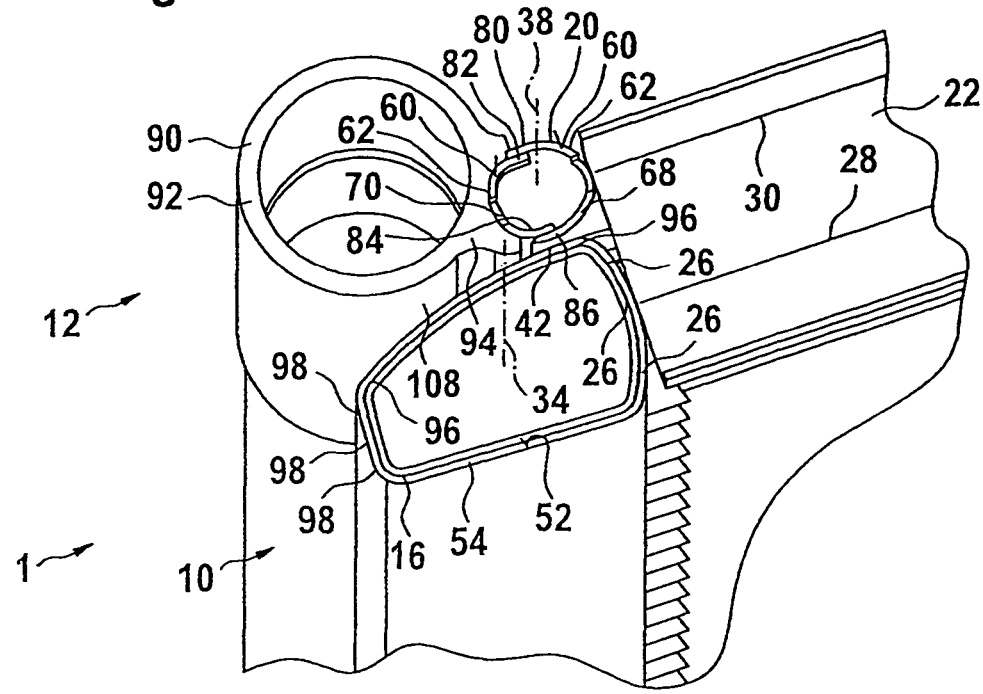
FIG. 2 shows a slightly tilted, enlarged, perspective partial view of the left upper area from FIG. 50.

FIGS. 1 and 2 each show a perspective, sectional, partial view of the embodiment according to FIG. 50, in a schematic representation. These perspective views are tilted slightly in relation to the view shown in FIG. 50.

Heat exchanger unit 1, shown in FIGS. 1 and 2, has a first heat exchanger 10 and a second heat exchanger 12. First heat exchanger 10 has two collector pipes 14, 16 situated at a distance from one another. Second heat exchanger 12 also has two collector pipes 18, 20 situated at a distance from one another.

Collector pipes 18 and 20 of the second heat exchanger on the one hand, as well as collector pipes 14 and 16 of the first heat exchanger on the other hand, are each connected to one another in terms of flow. This can be realized in a known manner. Thus, an already-discussed heat exchanger block 22 can be situated in the discussed collector pipes 14, 16 of first heat exchanger 10, or the discussed collector pipes 18, 20 of second heat exchanger 12. Here, separate heat exchanger blocks 22 can also be provided for the two heat exchangers 10, 12. Such a heat exchanger block 22 can for example be fashioned in such a way that a plurality of first (coolant) pipes situated in parallel are provided that connect collector pipe 14 of first heat exchanger 10 with collector pipe 16 of first heat exchanger 10. For this purpose, collector pipes 14, 16 have in their base walls 22 or 24 corresponding openings in which the (coolant) pipes can be received, or into which these pipes can be inserted. Webs are left between these openings, seen in the longitudinal direction of the collector pipes.

The (coolant) pipes are preferably flat pipes, such as for example flat-oval pipes. They can also have a rectangular cross-section, or can have some other shape.

Between the pipes situated in parallel that connect collector pipe 14 of the first heat exchanger with collector pipe 16 of the first heat exchanger, fins, such as corrugated fins, are for example provided.

Collector pipes 18, 20 of second heat exchanger 12 are likewise connected to one another via a multiplicity of pipes situated parallel to one another. Corrugated fins or the like can also be provided between these pipes.

It can also be provided both in first heat exchanger 10 and in second heat exchanger 12 that a plurality of pipes are situated between corrugated fins.

The (coolant) pipes of first heat exchanger 10 and the pipes of second heat exchanger 12 are different from one another, and separate fluid circuits are provided.

The corrugated fins of first heat exchanger 10 and the corrugated fins of second heat exchanger 12 can be common or different corrugated fins.

It can also be provided that first heat exchanger 10 and/or second heat exchanger 12 each has a plurality of (sub-) heat exchangers having separate fluid circuits. In particular, it can be provided that the first heat exchanger and/or the second heat exchanger are each, strictly speaking, a system of a plurality of heat exchangers, due to corresponding separations in the respective fluid circuit.

The direction of extension of the (coolant) pipes of first heat exchanger 10 is schematically indicated in FIGS. 1 and 2 by line 28, and the direction of extension of the pipes of the second heat exchanger is schematically indicated in these Figures by line 30.

In collector pipes 14 and 16 of first heat exchanger 10 and/or in collector pipes 18, 20 of second heat exchanger 12, separating walls can be provided at one or more points in the longitudinal direction, schematically indicated by longitudinal axes 32, 34 or 36, 38. Such separating walls can for example be provided in such a way that the fluid is guided back and forth between collector pipe 14 and collector pipe 16 of the first heat exchanger, or is guided back and forth multiple times, in particular in serpentine fashion. It can be provided that such intermediate walls are situated in such a way that a plurality of pipes that are situated so as to connect collector pipes 14, 16 and through which fluid flows in the same direction each open into the same chamber, which is limited by corresponding intermediate walls.

Intermediate walls can also be provided in a corresponding manner in heat exchanger 12.

In the first heat exchanger 10 and/or the second heat exchanger 12, such intermediate walls can be situated at different heights (seen in the longitudinal direction of the collector pipes) in collector pipes 14 and 16 and/or 18 and 20 allocated to one another.

However, and this holds for first heat exchanger 10 and/or second heat exchanger 12, it can also be provided that intermediate walls are provided essentially at the same height, so that first heat exchanger 10 and/or second heat exchanger 12 is divided, thus forming in the respective heat exchanger a plurality of sub-heat exchangers situated one over the other, having different fluid circuits.

In the embodiment according to FIGS. 1 and 2, collector pipe 14 of first heat exchanger 10 is situated adjacent to collector pipe 18 of second heat exchanger 12, in such a way that an intermediate space or a distance 40 is present between these collector pipes 14, 18.

Collector pipe 16 of first heat exchanger 10 is situated adjacent to collector pipe 20 of second heat exchanger 12, in such a way that an intermediate space or distance 42 is present between these pipes 16, 20.

These intermediate spaces or distances can for example be provided in such a way as to create a thermal separation.

A connecting collar 44 opens into collector pipe 14 of first heat exchanger 10. According to the embodiment shown in FIG. 1, this connecting collar 44 is situated on rear wall 46 of collector pipe 14 of first heat exchanger 10. In the embodiment according to FIG. 1, connecting collar 44 has an essentially cylindrical shape. The connecting collar can also have a different shape.

In the embodiment according to FIG. 1, the width or diameter of connecting collar 44 corresponds essentially to the width of rear wall 46, or is slightly smaller than the width of rear wall 46. This can also be realized differently.

Another connecting collar 320 of first heat exchanger 10, not shown in FIGS. 1 and 2, can likewise be situated on collector pipe 14 or on collector pipe 16.

Fluid can be supplied and conducted away through such connecting collars 44, 320.

In second heat exchanger 12, such connecting collars can also be present, though they are not depicted here.

In addition, in the perspective views according to FIGS. 1 and 2 a cross-sectional surface 48 of a covering wall 50 of collector pipe 14 of the first heat exchanger is shown, this cross-sectional surface 48 being oriented essentially perpendicular to the longitudinal direction 32 of this collector pipe 14. Covering wall 50 extends around a longitudinal axis 32.

In a corresponding manner, FIGS. 1 and 2 show a cross-section 52 of covering wall 54, extending around longitudinal axis 34, of collector pipe 16 of first heat exchanger 10, as well as a cross-sectional surface 56 of a covering wall 58 that extends around longitudinal axis 36 of collector pipe 18, and a cross-sectional surface 60 of covering wall 62 that extends around longitudinal axis 38 of collector pipe 20.

In the embodiment according to FIGS. 1 and 2, the shape of cross-sectional surface 48 corresponds essentially to the shape of cross-sectional surface 52, and the shape of cross-sectional surface 56 corresponds essentially to the shape of cross-sectional surface 60. However, this may also be otherwise.

FIGS. 1 and 2 show that collector pipes 18 and 20 of second heat exchanger 12, regarded in the cited cross-section, are each made up of two parts 64, 66 or 68, 70, or, in other words, have a multipart construction.

These parts 64, 66 or 68, 60 are however connected to one another, for example soldered to one another.

Regarded in cross-section, covering walls 58 and 62 have wall areas 72, 74 or 76, 78 or 80, 82 or 84, 86 that are situated in overlapping fashion in such a way that, seen in essentially in the radial direction, these wall areas are situated next to one another or one after the other, and are in contact with one another.

Wall segments 74, 76 or 80, 86 of part 66 or 68 of collector pipe 18 or 20 of second heat exchanger 12 are situated radially outside wall segments 72, 78 or 82, 84 of part 64, 70 of collector pipe 18 or 20 of second heat exchanger 12, with which they overlap. Part 66, 68 is here the part of collector pipe 18 or 20 that is positioned closer to collector pipe 20 or 18 of the same second heat exchanger.

In the embodiment according to FIGS. 1 and 2, first heat exchanger 10 is a radiator, in particular for an engine of a motor vehicle, and second heat exchanger 12 is an air conditioning condenser, in particular an air conditioning condenser for an air conditioning system of a motor vehicle.

In the embodiment according to FIGS. 1 and 2, second heat exchanger 12 has in addition a collector 90 of the second heat exchanger. The interior of collector 90 is connected to the interior of collector pipe 20 of second heat exchanger 12 via corresponding flow connections. Collector 90 is limited by an essentially cylindrical covering wall 92. The fluid flowing through second heat exchanger 12 is likewise conducted through collector 90. A drying device and/or a filter for the flowing fluid, and additional components if necessary, can be situated in this collector 90 in a known manner.

In the embodiment according to FIG. 2, collector 90 has a projection 94 provided on the outer surface of its cylindrical covering wall 92, by means of which collector 90 contacts collector pipe 20, in particular in the area of the outer surface of part 70. In the embodiment according to FIG. 2, collector 90 together with projection 94 is a part that is different from collector pipe 20 of second heat exchanger 12, and in particular is a part that is different from parts 68, 70 of this collector pipe 20, but that is connected, in particular soldered, to this collector pipe 20.

Collector 90 can also have one or more intermediate walls, and can act as a collector or collector system for various (sub-) heat exchangers of the second heat exchanger.

Terminating covers can be provided at the ends of collector pipes 14, 16, 18, 20 positioned in longitudinal direction 32 or 34 or 36 or 38. For each collector pipe, a separate terminating cover can be provided at each side. It can also be provided that adjacent collector pipes 14, 18 or 16, 20 of the first or second heat exchanger can be provided at their respective ends with a common terminating cover.

Collector 90 can also have a terminating cover at its ends positioned in the longitudinal direction.

This can be a separate terminating cover or a terminating cover that forms in common the termination of this collector 90 and/or of collector pipe 20 of the second heat exchanger and/or of collector pipe 16 of the first heat exchanger.

In the embodiment according to FIGS. 1 and 2, it is provided that the central longitudinal axes of collector pipes 14, 16, 18, 20, which are allocated to first heat exchanger 10 or to second heat exchanger 12, run essentially parallel to one another. In addition, in the embodiment according to FIGS. 1 and 2 it is provided that the longitudinal directions of the (coolant) pipes that connect collector pipe 14 of first heat exchanger 16 to connector pipe 16 of first heat exchanger 10 are on the one hand parallel to one another and are on the other hand parallel to the pipes that connect collector pipe 18 of the second heat exchanger to collector pipe 20 of the second heat exchanger.

In addition, it is provided that these pipes extend essentially in a direction that runs perpendicular to the central longitudinal axes of collector pipes 14, 16, 18, 20 of first heat exchanger 10 or of second heat exchanger 12. This can be realized such that the longitudinal axes of the pipes each run through a central longitudinal axis of a respective collector pipe 14, 16, 18, 20; it can also be realized such that they do not run through such a longitudinal axis; i.e., no point of intersection exists.

In the following, the exemplary cross-sectional shape according to the present invention of covering wall 50 of collector pipe 14 of first heat exchanger 10, or the cross-sectional shape of covering wall 54 of collector pipe 16 of first heat exchanger 10, indicated as an example in FIGS. 1 and 2, is described. Here (and this also holds for the other Figures), unless otherwise specified the cross-sectional surface can be, or is, positioned essentially perpendicular to the longitudinal axis of this collector pipe.

Because according to FIGS. 1 and 2 these cross-sectional surfaces have the same shape, the cross-sectional surface will be explained only on the basis of FIG. 1.

In this connection it is to be noted that in FIGS. 1 and 2 the cross-sectional surfaces of collector pipes 14, 16 of first heat exchanger 10 are the same; the cross-sectional surfaces of collector pipes 18, 20 of the second heat exchanger are also the same in FIGS. 1 and 2. They can also be different. It can also be provided that the collector pipes of the same heat exchanger have different cross-sectional surfaces.

Seen in the cross-section situated perpendicular to the central longitudinal axis, covering wall 50 of collector pipe 14 of first heat exchanger 10 has a base wall 24, a rear wall 46, a front wall 96, and an outer wall 98. Here it is also to be noted that the designation of these walls has in particular been selected so as to make them identifiable; thus, the term "outer wall" is not intended to be the outer part of a wall, in contrast to a possible inner part of a wall. On the designation of the walls, see in particular FIG. 4, in which the wall designations are explained in general form.

Seen in cross-section, in the embodiment according to FIGS. 1 and 2 covering wall 50 of collector pipe 14, 16 of first heat exchanger 10 has a one-part construction, or is not provided with overlapping wall areas.

Base wall 24 has a convexly curved shape. Radius of curvature R, indicated schematically, of curved base wall 24 can be constant along the length (segment length), regarded in cross-section, of this base wall 24, or can vary along this length. Base wall 24 can for example be curved in the form of a segment of a circle, or a segment of an ellipse, or in some other way.

Base wall 24 can be curved in some sections or can be curved essentially over its entire length, in the cross-section regarded here. In this cross-section, base wall 24 can in particular be curved in such a way as to be symmetrical in relation to an axis that is parallel to the pipes that connect collector pipe 14 to connector pipe 16. However, it can also be asymmetrical in relation to such an axis.

In particular, the relation between the radius of curvature, or radii of curvature, of the base wall and the length of the curved area of this base wall 24 can be as described at another place in this description referring to curved walls.

In the embodiment according to FIGS. 1 and 2, front wall 96 also has a curved construction. According to FIGS. 1 and 2, the front wall is curved along its entire length, seen in the cross-section considered here. The curvature of this front wall 96 can for example also be as described at another place in the present description referring to curved walls.

The front wall that is convexly curved in FIGS. 1 and 2 is, in these Figures, curved in such a way that—seen in the cross-section viewed here—in the direction of the cross-sectional plane perpendicular to longitudinal direction 28 of the pipe, the distance of this front wall from the central longitudinal axis of collector pipe 18 of second heat exchanger 12 increases along the segment running from base wall 24 to outer wall 98 (seen in this direction).

In the embodiment according to FIGS. 1 and 2, outer wall 96 is oriented essentially perpendicular to rear wall 46. In the embodiment according to FIGS. 1 and 2, this outer wall 98 and this rear wall 46 each have a flat construction, or, viewed in cross-section, have a straight construction.

Viewed in cross-section, rear wall 46 runs essentially parallel to longitudinal axis 28 or 30 of the pipes that are situated between collector pipes 14 and 16 or 18 and 20 of first heat exchanger 10 or of second heat exchanger 12.

In the embodiment according to FIGS. 1 and 2, outer wall 98 is situated essentially perpendicular to these pipe longitudinal axes 28, 30.

Transition area 100 between rear wall 46 and base wall 24, transition area 102 between base wall 24 and front wall 96, transition area 104 between front wall 96 and outer wall 98, and transition area 106 between outer wall 98 and rear wall 46 are all formed so as to be rounded off in the embodiment according to FIGS. 1 and 2. Instead of this rounded-off shape in transition areas 100, 102, 104, and 106, a differently shaped transition area can also be provided, such as for example a transition area determined by the paths of the tangents of the respective walls (for example flat walls) that meet each other in this area, or a chamfered area.

In the embodiment according to FIGS. 1 and 2, collector 90 of second heat exchanger 12 is situated in such a way in relation to collector pipe 20 of second heat exchanger 12 and to collector pipe 16 of first heat exchanger 10 that—regarded in the cross-section perpendicular to the central longitudinal axes of these components—perpendicular to pipe longitudinal axes 30 or 28, the distance between the central longitudinal axis of collector 90 and the central longitudinal axis of collector pipe 16 of first heat exchanger 10 is greater than the distance between the central longitudinal axis of collector pipe 20 of second heat exchanger 12 and the central longitudinal axis of collector pipe 16 of first heat exchanger 10. In addition, in the embodiment according to FIGS. 1 and 2, between collector 90 and collector pipe 16 of first heat exchanger 10 there is an intermediate space or distance 108; this can in particular be such that a thermal separation is present.

Figure 3:
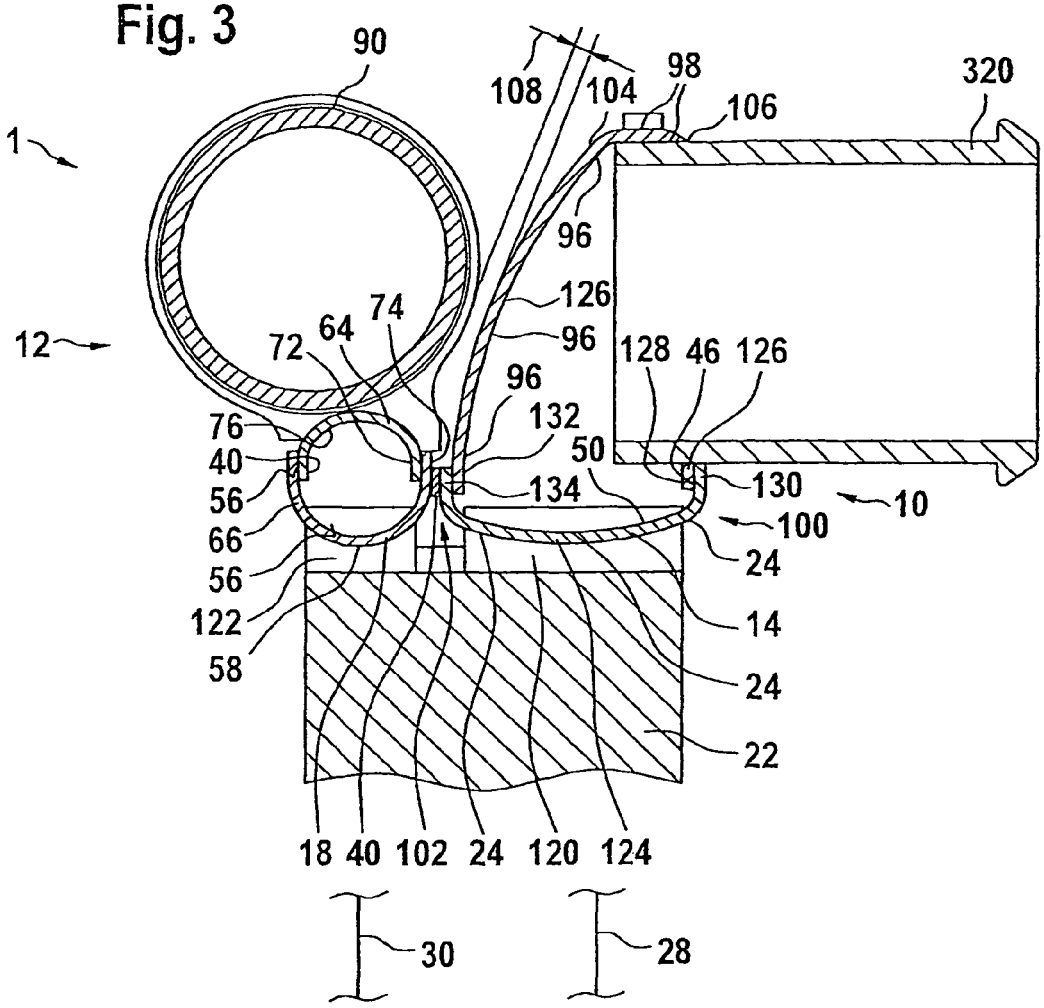
FIG. 3 shows a sectional view along the line III-III from FIG. 50, in a schematic partial view.

FIG. 3 shows a sectional view along the line III-III from FIG. 50, in a partial view.

FIG. 3 shows clearly that an intermediate space or distance 108 is present between collector 90 and collector pipe 14 of first heat exchanger 10.

Such a distance or intermediate space can in particular be such as to provide a thermal separation.

FIG. 3 illustrates an example of how the pipes that connect the collector pipes belonging to identical heat exchangers 10 or 12 can be provided. Thus, for example in FIG. 3 a pipe 120 is partially shown that is inserted into an opening (not shown) in base wall 24 of collector pipe 14 of first heat exchanger 10, and is inserted into an opening (also not shown) in floor 26 of collector pipe 16 of first heat exchanger 10. In addition, a pipe 122 is shown that is inserted in a corresponding manner into openings (also not shown) of collector pipe 18 and of collector pipe 20.

In the exemplary embodiment according to FIG. 3, the width of pipe 120 is somewhat smaller than the width of base wall 24, and the width of pipe 122 is slightly smaller than the width of collector pipe 18. These width relations can also be different in preferred embodiments.

In contrast to the embodiment according to FIGS. 1 and 2, in the embodiment according to FIG. 3—in the cross-section perpendicular to the central longitudinal axis of collector pipe 14 or 16 of the first heat exchanger—covering wall 50 of this collector pipe is shown in two parts, or is constructed in two parts, or is made up of two separately manufactured parts 124, 126; this indicates an alternative construction that can also be provided in the representation according to FIGS. 1 and 2, or 50, just as the one-piece construction shown in FIGS. 1 and 2 can also alternatively be provided in FIG. 3.

One of these parts 124 has base wall 24.

In the embodiment according to FIG. 3, areas 128, 132 of part 126 are constructed so as to overlap with areas 134, 130 of the other part 124, in such a way that these areas are in contact with one another. These areas can for example be soldered together.

Part 134 essentially has a base wall 24 as well as transition areas 100 to rear wall 46, or 102 to front wall 96. In the embodiment according to FIG. 3, part 126, which essentially has front wall 96, outer wall 98, and rear wall 46, is inserted into part 124. In an alternative specific embodiment, however, parts 124, 126 can also be shaped or dimensioned in such a way that part 124 is inserted into part 126, or can be so inserted.

Part 134 is shaped in such a way that segments having areas 130, 134 protrude in the direction facing away from heat exchanger block 22. In the exemplary specific embodiment shown in FIG. 3, the height of part 124—measured in the longitudinal direction of extension of pipe 120—is less than one-third of the width, measured perpendicular thereto in the depicted cross-section, of this part 124. It can also be provided that this height is less than one-fourth of the width, or is less than one-fifth of the width, or is less than one-sixth of the width, or is smaller.

It can also be provided that this height is less than half the width. Other width-height relations are also preferred.

Figure 4:
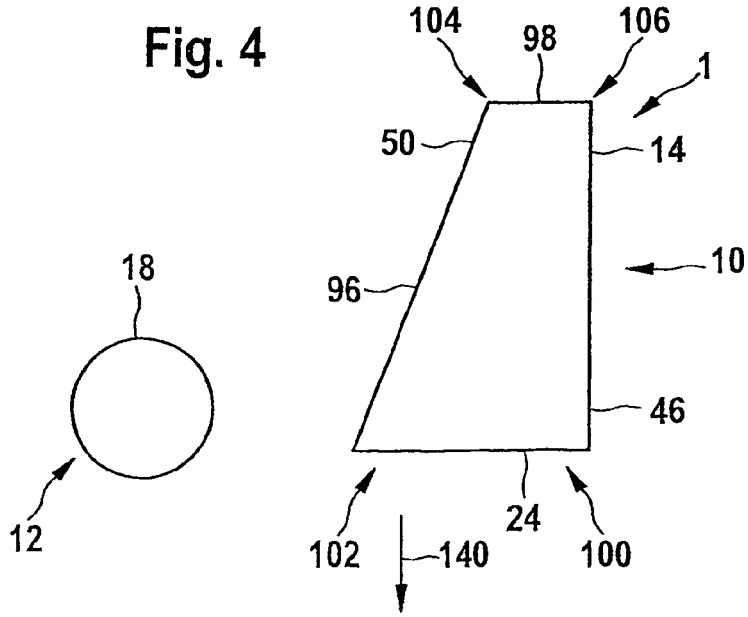
FIGS. 4 to 28 show exemplary cross-sections according to the present invention of the covering wall of a collector pipe of a first heat exchanger, situated perpendicular to the longitudinal axis of this collector pipe.

FIG. 4 shows a partial sectional view of an exemplary heat exchanger unit 1 according to the present invention in a schematic representation.

However, the terms "base wall," "front wall," "outer wall," "rear wall," as well as the "transition areas" of these walls, are also intended to be explained on the basis of FIG. 4.

FIG. 4 shows a section perpendicular to the longitudinal axis of collector pipe 14 of first heat exchanger 10, or perpendicular to the longitudinal axis of collector pipe 18 of second heat exchanger 12.

As already mentioned above, in this embodiment collector pipes 14 and 18 are also situated adjacent to one another and at a distance from one another.

A heat exchanger block 22 (not shown) is situated in the direction indicated by arrow 140.

An additional collector pipe 16 of first heat exchanger 10 and an additional collector pipe 20 of second heat exchanger 12 are also positioned in this direction. In the embodiment shown as an example in FIG. 4, the covering wall of collector pipe 18 of second heat exchanger 12 has a cylindrical shape, or has a circular cross-section.

The covering wall of collector pipe 14 of first heat exchanger 10 has a base wall 24, as well as a front wall 96, an outer wall 98, and a rear wall 46. In the exemplary embodiment according to FIG. 4, outer wall 98 is situated essentially parallel to base wall 24, these walls 24, 98 being situated perpendicular to rear wall 46. However, this can also be otherwise, as is shown for example in other Figures of this description. In the embodiment according to FIG. 4, seen in cross-section the length of base wall 24 is greater than the length of outer wall 98. In this exemplary embodiment, base wall 24 is even longer than twice the length of outer wall 98. This can also be realized differently.

In the embodiment shown in FIG. 4, front wall 50 is situated so as to be inclined in relation to base wall 24 or to outer wall 98, or to pipes 120, 122 (not shown). This can also be otherwise according to the present invention.

Base wall 24 is a wall of collector pipe 14 that faces the other collector pipe 16 (not shown) of first heat exchanger 10.

Front wall 96 of collector pipe 14 is a wall that faces adjacently situated collector pipe 18 of the second heat exchanger.

Outer wall 98 is a wall of collector pipe 14 facing away from the other collector pipe 16 (not shown in FIG. 4).

Rear wall 46 of collector pipe 14 is a wall facing away from collector pipe 18, which is adjacent to collector pipe 14, of the second heat exchanger.

The transition between base wall 24 and front wall 96 is formed by a transition area 102.

The transition between front wall 96 and outer wall 98 is formed by a transition area 104, and the transition between outer wall 98 and rear wall 46 is formed by a transition area 106. The transition between rear wall 46 and base wall 24 is formed by a transition area 100. Such a transition area can be differently shaped, for example rounded off or formed as a chamfer or as a point.

In the cross-section discussed here, the length of such a transition area—seen along the covering wall—can be less than 10 times the thickness of the covering wall or less than eight times the thickness of the covering wall or less than six times the thickness of the covering wall or less than five times the thickness of the covering wall or less than four times the thickness of the covering wall or less than three times the thickness of the covering wall or less than two times the thickness of the covering wall.

In another preferred embodiment, the transition area can also have other dimensions.

On the basis of FIGS. 5 to 28, exemplary forms of collector pipe 14 or of collector pipes 14, 16 of first heat exchanger 10 are now explained.

FIGS. 5 to 28 each show a cross-section of covering wall 50 of collector pipe 14 of first heat exchanger 10 that is perpendicular to the central longitudinal axis of this collector pipe 14.

In each of the representations according to FIGS. 5 to 28, a wall 24 or 46 or 96 or 98 is shown as a double line, while the remaining walls are each shown as single (solid) lines.

The wall shown in each case as a double line is explained below on the basis of these Figures as a preferred embodiment of the wall in question. The walls of peripheral wall 50 shown as single lines show exemplary or preferred embodiments of the remaining walls, as well as their positions relative to one another.

Figure 5:
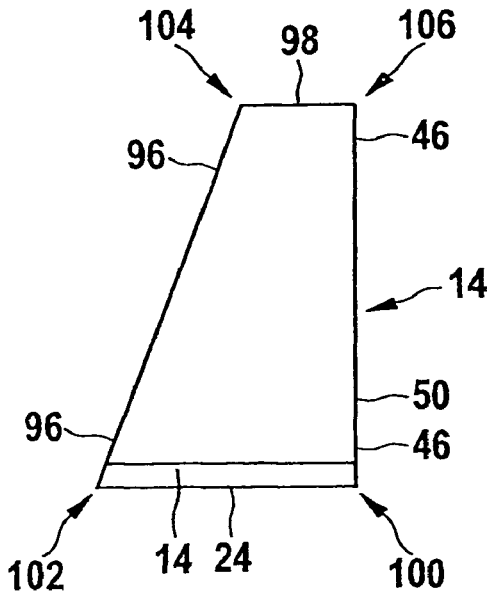
Figure 6:
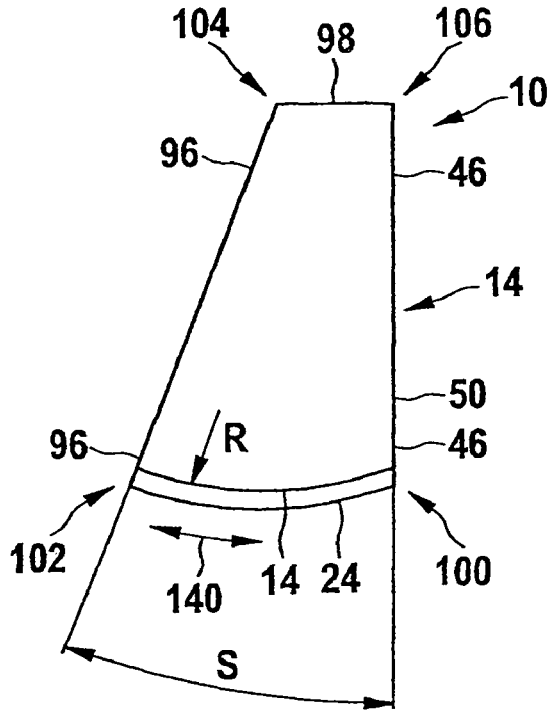

Preferred embodiments of base wall 24 are explained on the basis of FIGS. 5 and 6. In FIGS. 5 and 6, rear wall 46 is oriented essentially parallel to pipes 120 (not shown) of the first heat exchanger. In the embodiments according to FIGS. 5 and 6, outer wall 98 is oriented perpendicular to these pipes 120.

In the embodiments according to FIGS. 5 and 6, front wall 96 is oriented so as to be inclined to these pipes 120. The angle enclosed between pipes 120, or the central longitudinal axis of these pipes 120, and front wall 96 is between 5° and 85°. Preferably, this angle can be between 10° and 80°, particularly preferably between 20° and 70°. Furthermore, it is preferred that this angle be between 30° and 60°.

Rear wall 46, outer wall 98, and front wall 96 each have a flat construction in the embodiments according to FIG. 5 and FIG. 6, and essentially have no bends [or: breaks, kinks].

In the embodiment according to FIG. 5, base wall 24 also has a flat or straight construction, and runs essentially perpendicular to the longitudinal axis of pipes 120 of first heat exchanger 10.

In the embodiment according to FIG. 6, base wall 24 has a convexly curved construction.

Along base wall 14 (the corresponding path is schematically indicated by curved double arrow 140), radius of curvature R is essentially constant in the embodiment according to FIG. 6. The curvature of base wall 24 extends over the entire base wall (viewed in cross-section). The segment length of the curved area, or of the curved base wall, is in the embodiment according to FIG. 6 smaller than ($x*\pi$) times half the curvature radius, where x is greater than zero and less than or equal to 0.8.

Exemplary values for the relation between the segment length and the curvature radius are also cited at other locations in this description.

It is to be noted—and this is not shown in FIG. 6—that the curvature of the base wall can also be such that the radius of curvature R has various values along the segment length. In particular, it can also be provided that base wall 24 is curved in the manner of a segment of an ellipse.

In particular in embodiments in which the curvature radius under discussion is not constant, the indicated relations can be present between the curvature radius and the segment length with regard to the mean curvature radius ($R_{mean}$) of the base wall.

In the embodiment according to FIG. 6, there exists an axis, parallel to a pipe 120 of first heat exchanger 10, that is essentially an axis of symmetry of base wall 24. However, the embodiment shown in FIG. 6 of a base wall 24 can also be modified such that there does not exist an axis that is parallel to the longitudinal axis of a pipe 120 and that is an axis of symmetry of base wall 24.

It is to be noted that according to the present invention a curved base wall can be present not only in heat exchanger units having a first heat exchanger 10 and a second heat exchanger 12, but also in heat exchanger units having only one heat exchanger. In particular, it is provided that such a curved base wall of the type described above is present in a heat exchanger that is a radiator.

In the embodiment according to FIG. 6, as also in the embodiments shown or explained on the basis of FIGS. 4, 5 and 7 to 28, covering wall 50 of collector pipe 14 has a non-circular shape.

In FIGS. 7 to 16, exemplary embodiments according to the present invention of rear wall 46 of collector pipe 14 or 16 of a first heat exchanger are shown.

Figure 7:
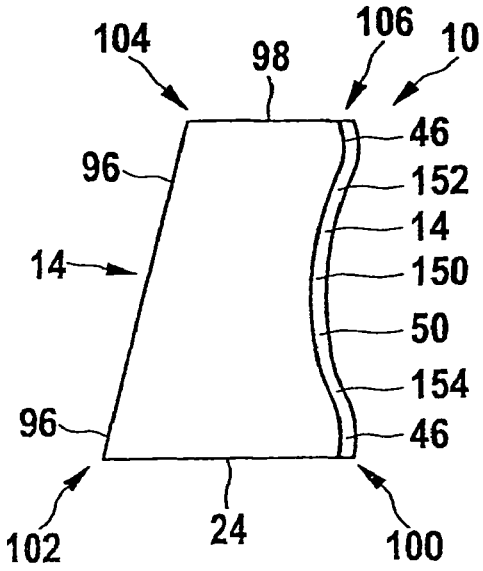

In the embodiment according to FIG. 7, rear wall 46 has a concavely curved segment 150. Convexly curved segments 152, 154 are connected—in cross-section—to the ends of this concavely curved segment. Rear wall 46 is fashioned with a continuous curvature in the embodiment according to FIG. 7.

Figure 8:
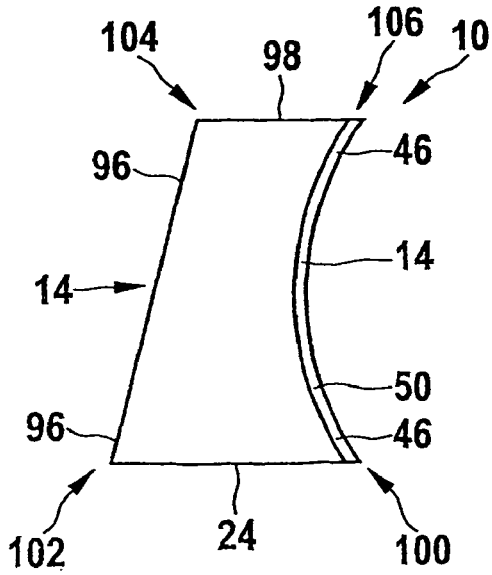

In the embodiment according to FIG. 8, rear wall 46 also has a continuously curved construction. However, rear wall 46 is continuously concavely curved in the embodiment according to FIG. 8.

According to FIGS. 7 and 8, rear wall 46 is constructed such that there exists an axis perpendicular to the longitudinal axis of pipes 120 that is an axis of symmetry for the course of rear wall 46. It can also be provided that such an axis of symmetry for the course of rear wall 46 does not exist.

Figure 9:
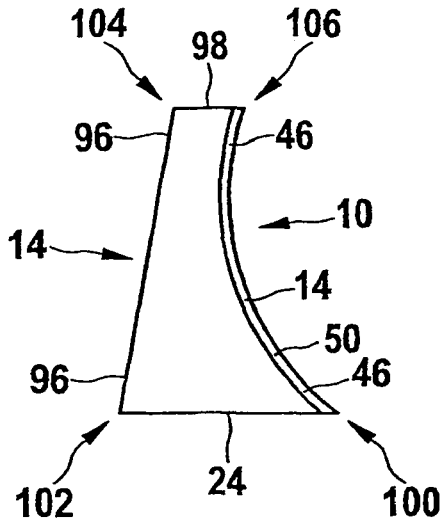

An exemplary embodiment that is modified in relation to the embodiment according to FIG. 8 is shown in FIG. 9.

In the embodiment according to FIG. 9 as well, rear wall 46 is continuously curved. In the embodiment according to FIG. 9, this curvature is such that the end of rear wall 46 that abuts outer wall 98—in relation to an axis perpendicular to the longitudinal axis of pipes 120—is positioned further in the direction of front wall 96 than is the end of the rear wall that adjoins base wall 24.

Figure 10:
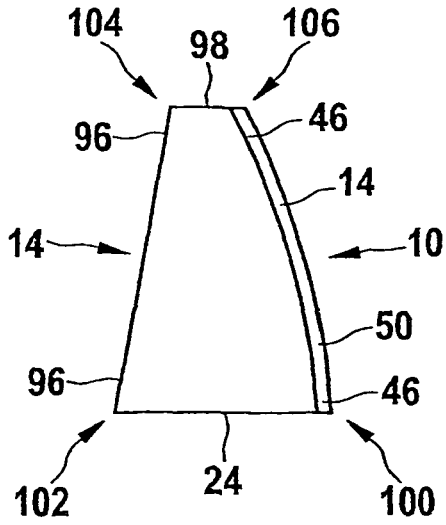

FIG. 10 shows an embodiment in which rear wall 46 is essentially continuously convex in construction. In the embodiment according to FIG. 10, the curvature of rear wall 46 is such that there does not exist an axis, perpendicular to the longitudinal axis of pipes 120, that is an axis of symmetry of curved rear wall 46. In the embodiment according to FIG. 10, the curvature of rear wall 46 is such that the end of rear wall 46 positioned at outer wall 98—in relation to an axis perpendicular to the longitudinal axis of pipes 120—is positioned further in the direction of front wall 96 than is the end of rear wall 46, which is positioned on base wall 24.

Figure 11:
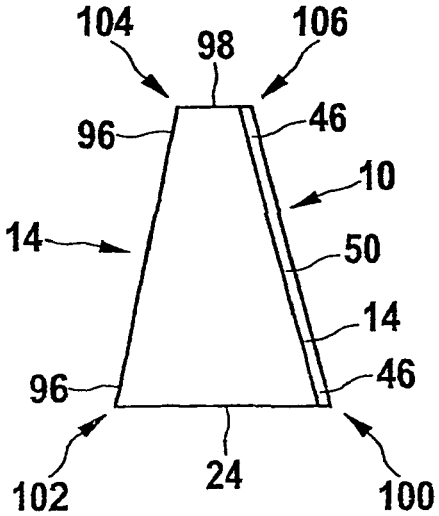

FIG. 11 shows an embodiment in which rear wall 46 is flat and is inclined in relation to a longitudinal axis of a pipe 120. This angle enclosed between the longitudinal axis of a pipe 120 and rear wall 46 is preferably in the range between 5° and 85°, preferably between 10° and 80°, preferably between 20° and 70°, preferably between 30° and 60°.

Figure 12:
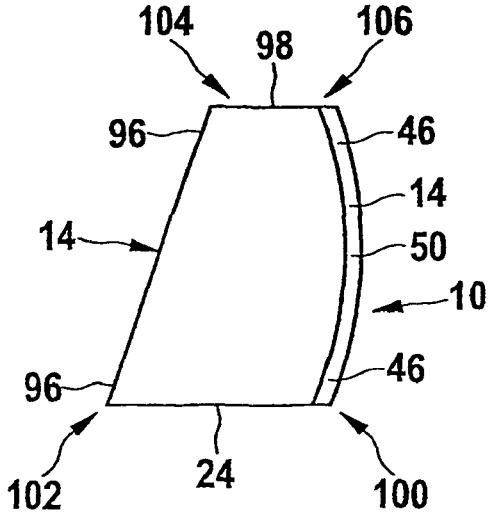

FIG. 12 shows an embodiment in which, as in the embodiment according to FIG. 10, the rear wall is convex. In contrast to the embodiment according to FIG. 10, however, in the embodiment according to FIG. 12 rear wall 46 is curved in such a way that an axis perpendicular to the longitudinal axis of a pipe 120 exists that is an axis of symmetry of curved rear wall 46.

Figure 13:
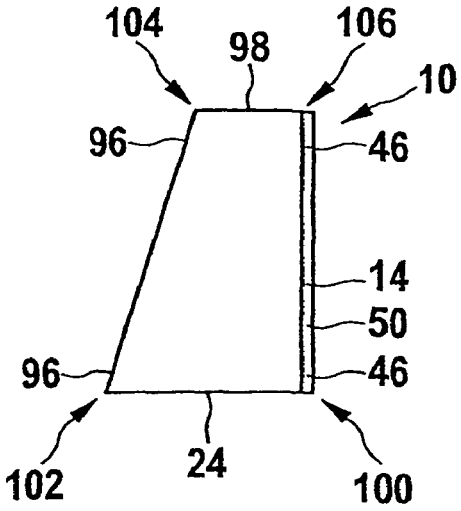

FIG. 13 shows an exemplary embodiment in which rear wall 46 has a flat construction and is oriented parallel to the longitudinal axis of a pipe 120.

Figure 14:
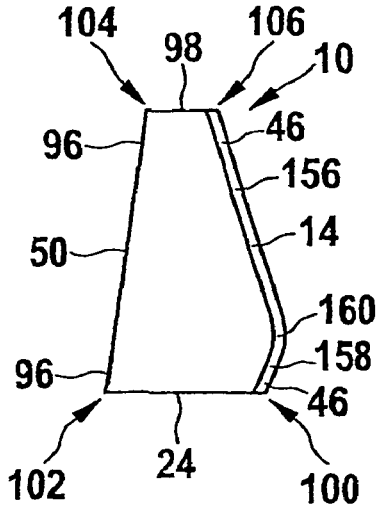

In the embodiment according to FIG. 14, rear wall 46 has two wall segments 156, 158 each having a flat or straight construction. Wall segments 156 and 158 are each situated at an angle to the longitudinal axis of a pipe 120 that is greater than 5° and less than 85°, preferably greater than 10° and less than 80°, particularly preferably greater than 20° and less than 70°, particularly preferably greater than 30° and less than 60°.

Wall segments 156, 158 enclose an angle that is greater than 95° and less than 175°, preferably greater than or equal to 100° and less than or equal to 170°, particularly preferably greater than or equal to 20° and less than or equal to 160°, particularly preferably greater than or equal to 130° and less than or equal to 150°.

The transition between these wall segments 156 and 158 is constructed so as to be rounded off.

Figure 15:
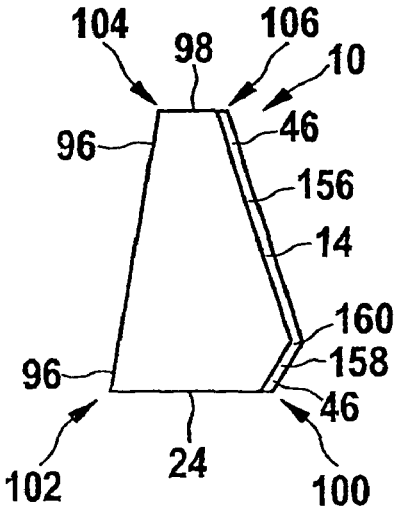

FIG. 15 shows an embodiment of rear wall 46 that differs from that shown in FIG. 14 in that the transition 160 between flat wall segment 156 and flat wall segment 158 has a pointed construction.

In FIGS. 14 and 15, flat wall segment 158 facing base wall 24 is—in cross-section—shorter than the wall segment facing outer wall 156. Wall segment 156 can for example be at least twice as long or at least three times as long or at least four times as long as wall segment 158. Other relations are also preferred.

Figure 16:
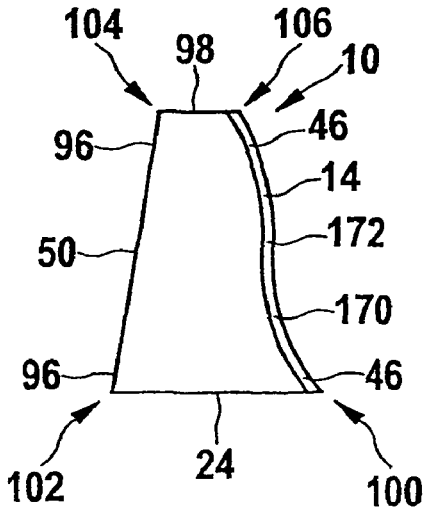

FIG. 16 shows an embodiment of a rear wall 46 that is continuously curved and that has a concave segment 170 as well as a convexly curved segment 172. Concavely curved segment 170 extends from base wall 24 to convexly curved segment 172, and convexly curved segment 172 extends up to outer wall 98.

The concavely curved segment and the convexly curved segment are situated relative to one another and shaped such that rear wall 46 runs increasingly in the direction of front wall 96, in relation to an axis perpendicular to a longitudinal axis of a pipe 120, and given a course of rear wall 46 running from base wall 24 in the direction of outer wall 98.

In each of the exemplary embodiments shown in FIGS. 7 and 16, the base wall has a flat construction and is oriented perpendicular to a longitudinal axis of a pipe 120.

In the embodiments according to these Figures, outer wall 98 has a flat or straight construction and is oriented perpendicular to a longitudinal axis of a pipe 120.

In each of the exemplary embodiments according to FIGS. 7 to 16, front wall 96 is inclined in relation to a central axis of a pipe 120. The angle enclosed between such an axis of a pipe 120 and the flat front wall 96 can in particular be as described at another place in this description, in particular in connection with FIGS. 5 and 6. In each of FIGS. 5 to 16, front wall 96 is constructed in such a way that, in relation to an axis perpendicular to a longitudinal axis of a pipe 120, the end situated at outer wall 98 is displaced further in the direction of rear wall 98 [sic] than is the end of front wall 96, which faces base wall 24.

According to FIGS. 5 to 16, the length of base wall 24 is—regarded in cross-section—greater than the length of outer wall 98. FIGS. 5 to 16 show partial embodiments in which the projection of outer wall 98—regarded in cross-section—onto base wall 24 is such that the end, facing rear wall 46, of outer wall 98, as well as of base wall 24, is congruent (cf. FIG. 5 to FIG. 8, FIG. 12, and FIG. 13); in part, embodiments are shown in which, in the cited projection, the end of outer wall 98 facing rear wall 46 is situated closer to front wall 96 than is the end of base wall 24 facing router wall 46 (cf. FIG. 9 to FIG. 11, as well as FIGS. 14 to 16).

In all the embodiments shown in FIGS. 5 to 16, in the cited projection the end of outer wall 98 facing the front wall is situated closer to rear wall 46 than is the end of base wall 24 facing front wall 96.

On the basis of FIGS. 17 to 25, exemplary embodiments of front wall 96 according to the present invention are now described.

Figure 17:
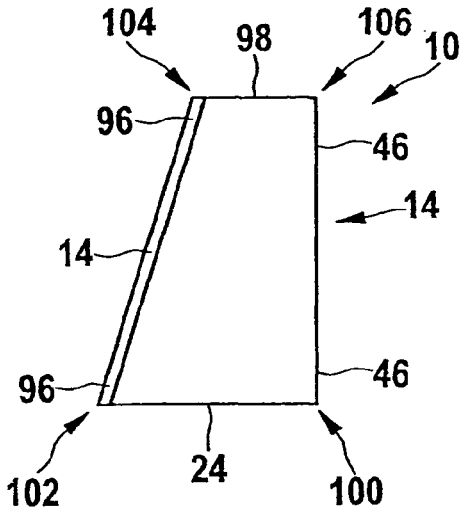

In the embodiment shown in FIG. 17, front wall 96 is continuously straight or flat in construction, and is inclined in relation to the longitudinal axis of a pipe 120 (not shown) of first heat exchanger 10. The angle between front wall 96 and the longitudinal axis of pipe 120 is greater than 5° and is less than 85°, preferably greater than 10° and less than 80°, particularly preferably greater than 20° and less than 70°, particularly preferably greater than 30° and less than 60°.

In the embodiment according to FIG. 17, the angle between front wall 96 and base wall 24 is less than 90°, and is in particular less than 80°, in particular less than 70°. In relation to an axis perpendicular to the longitudinal axis of a pipe 120, the end of front wall 96 facing outer wall 98 is situated closer to rear wall 46 than is the end of front wall 96 facing base wall 24.

Figure 18:
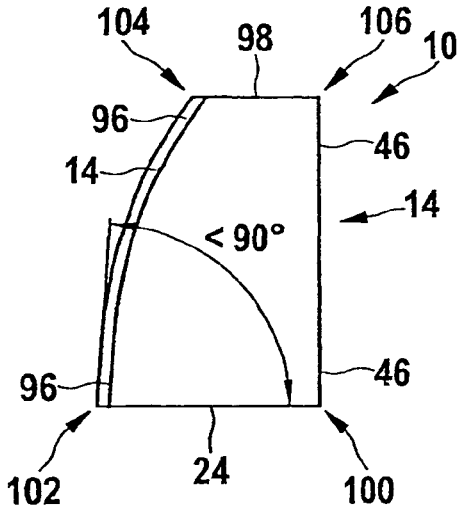

FIG. 18 shows an exemplary embodiment in which front wall 96 is essentially continuously convexly curved. The radius of curvature can here be constant or can be different at different points in the course of the wall.

In relation to an axis perpendicular to the longitudinal axis of a pipe 21 of first heat exchanger 10, the end of curved front wall 96 facing outer wall 98 is situated closer to rear wall 46 than is the end facing base wall 24.

In particular, it can be provided that all tangents situated on curved front wall 96 enclose with the base wall an angle that is less than 90° and in particular is in the range from 5° to 85°, preferably between 10° and 80°, particularly preferably between 20° and 70°.

Figure 19:
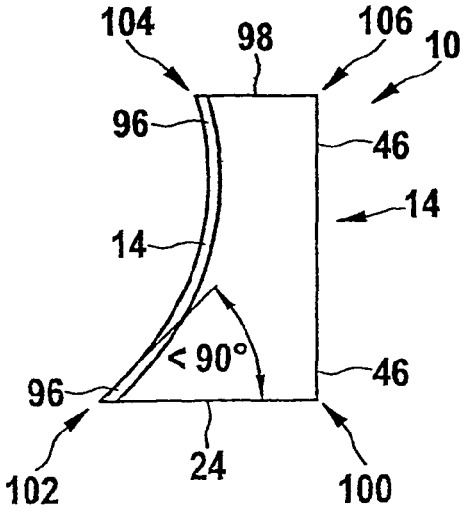

FIG. 19 shows an exemplary embodiment in which the front wall is continuously concavely curved.

In relation to an axis that is perpendicular to the longitudinal axis of a pipe 120 of first heat exchanger 10, the end of curved front wall 96 facing outer wall 98 is situated closer to rear wall 46 than is the end of front wall 96 facing base wall 24. In this embodiment, it can be provided that one or more tangents to curved front wall 96 in the area of the end of the front wall facing base wall 24 enclose with this base wall 24 an angle that is less than 90°, for example within the ranges cited in reference to FIG. 18.

Figure 20:
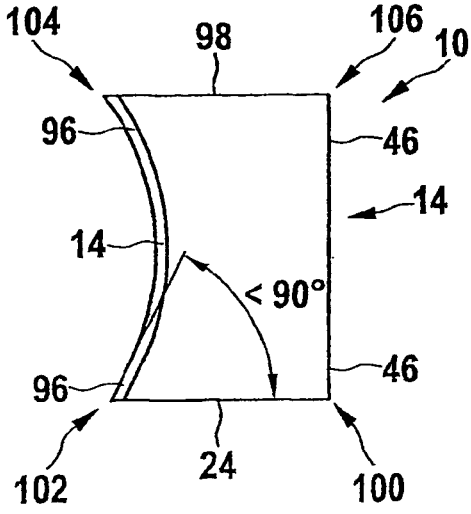

The same holds for the corresponding angles in relation to FIG. 20. According to FIG. 20, the front wall is likewise continuously concavely curved.

While in the embodiment according to FIG. 19, no axis perpendicular to the longitudinal axis of a pipe exists that is an axis of symmetry of curved front wall 96, such an axis does exist in the embodiment according to FIG. 20.

Figure 21:
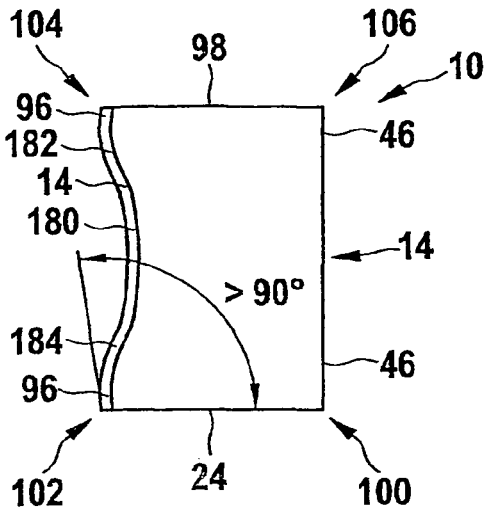

FIG. 21 shows an embodiment in which front wall 96 is continuously curved and has a concavely curved segment 180.

At both ends of this concavely curved segment 180, convexly curved segments 182, 184 are connected to front wall 96 that extend up to base wall 24 or up to outer wall 98.

In the embodiment according to FIG. 21, there exists an axis, perpendicular to a longitudinal axis of a pipe 120 of the first heat exchanger, that is an axis of symmetry of front wall 96.

In the area of the end of front wall 96 facing base wall 24, a tangent to this front wall encloses with base wall 24 an angle that is greater than 90°, preferably greater than 95°, preferably greater than 100°, preferably greater than 110°, preferably greater than 120°.

Figure 22:
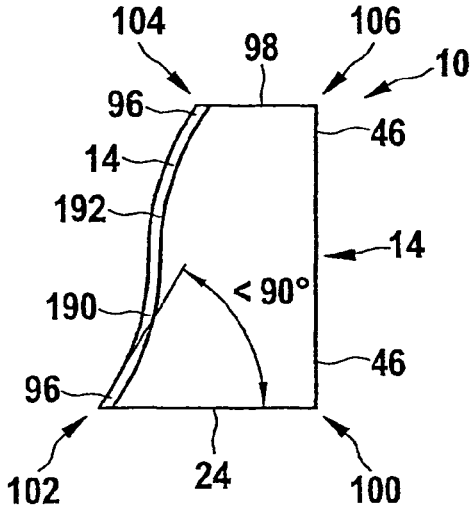

In the embodiment according to FIG. 22, in which front wall 96 is likewise continuously curved, the angle between such a tangent and the base wall is less than 90° and is preferably less than 85°, particularly preferably less than 80°, particularly preferably less than 70°.

In the embodiment according to FIG. 22, front wall 96 has a concavely curved segment 190 as well as a convexly curved segment 192. The concavely curved segment is connected to base wall 24 and the convexly curved segment is provided between this concavely curved segment and outer wall 98.

Following the course of base wall 24 to outer wall 98, in the embodiment according to FIG. 22 front wall 96 is increasingly displaced—in relation to an axis perpendicular to a pipe 120—in the direction of rear wall 46.

Figure 23:
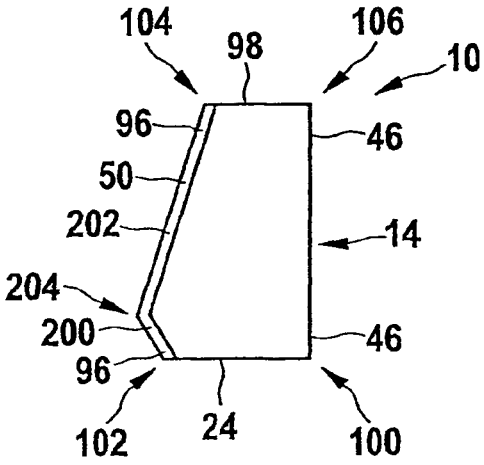

In the embodiment according to FIG. 23, front wall 96 has segments 200, 202 that are straight or flat, each situated at an angle, or obliquely, to the longitudinal axis of a pipe 120 of the first heat exchanger. Flat segment 200 facing base wall 24, as well as segment 202 facing outer wall 98, each enclose with the longitudinal axis of a pipe 120 an angle in the range between 5° and 85°, preferably between 10° and 80°, particularly preferably between 20° and 70°, particularly preferably between 30° and 60°. Flat segment 200 encloses with flat segment 202 of the front wall an angle that is greater than 90° and is preferably in the range between 95° and 175°, preferably between 100° and 170°, particularly preferably between 110° and 160°, particularly preferably between 130° and 150°.

Starting from its beginning at base wall 24, flat segment 200 first runs obliquely in direction 46 facing away from the rear wall; segment 202 connected to this flat segment 200 runs from flat segment 200 in the direction facing rear wall 46 or outer wall 98, up to outer wall 98.

Transition 204 between flat segment 200 and flat segment 202 is fashioned with a point in the embodiment according to FIG. 23.

Figure 24:
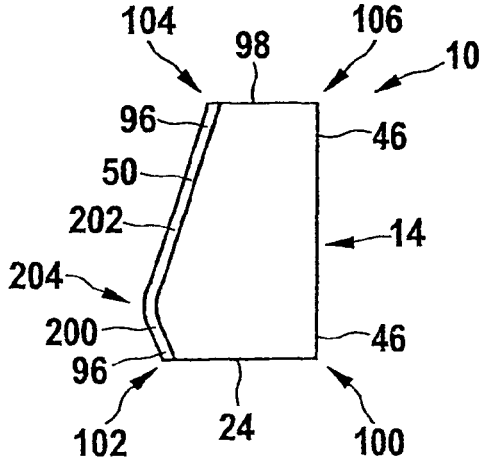

The embodiment according to FIG. 24 is similar to that according to FIG. 23, and differs from it in that transition 204 between flat segment 200 and flat segment 202 is fashioned so as to be rounded off.

Figure 25:
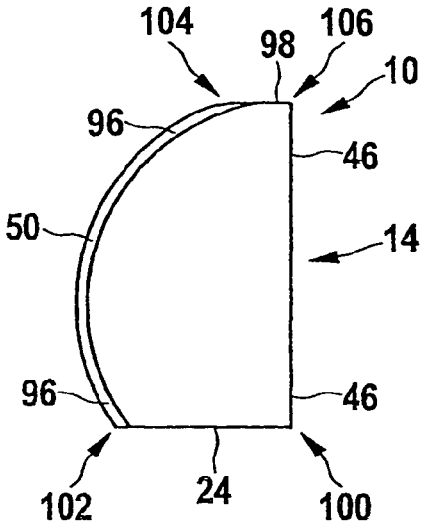

In the exemplary embodiment according to FIG. 25, front wall 96 has a curved, concave construction. The curvature of this continuously curved front wall 96 is such that front wall 96 runs in the direction facing away from rear wall 46 both from base wall 24 and also from outer wall 98, thus forming a bulging contour in which the curved area protrudes beyond the end facing away from rear wall 46 of base wall 24 and the end facing away from rear wall 46 of outer wall 98, in the direction facing away from rear wall 46.

In the exemplary embodiments according to FIGS. 17 to 25, rear wall 46 is oriented essentially parallel to a longitudinal axis of a pipe 120 of the first heat exchanger.

Base wall 24 is oriented essentially perpendicular to a longitudinal axis of a pipe 120 of a first heat exchanger 10.

Outer wall 98 is oriented essentially perpendicular to a longitudinal axis of a pipe 120 of first heat exchanger 10.

In some of the embodiments explained on the basis of FIGS. 17 to 25 (FIG. 17 to FIG. 19, FIG. 22 to FIG. 25), outer wall 98 is, seen in cross-section, shorter than base wall 24. In some other embodiments explained on the basis of these Figures (see FIG. 20, FIG. 21), the length of outer wall 98 corresponds to the length of base wall 24.

Figure 26:
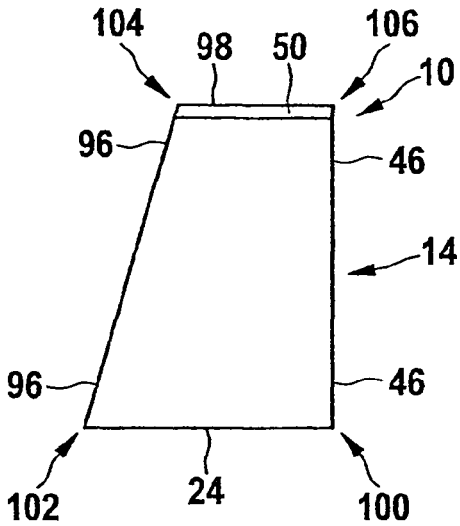
Figure 27:
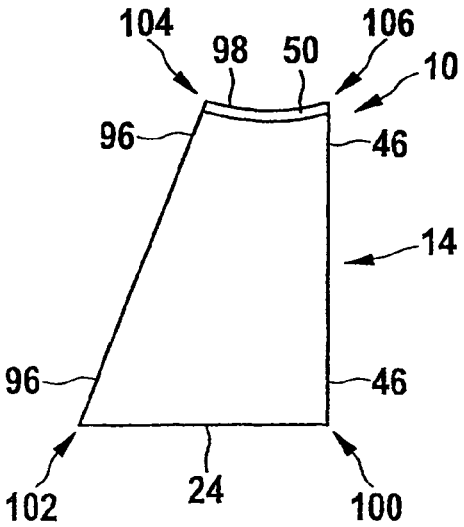
Figure 28:
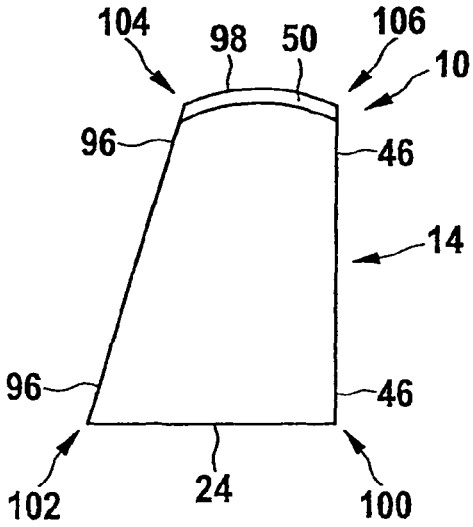

Exemplary embodiments of outer wall 98 are now explained on the basis of FIGS. 26 to 28.

In the embodiment according to FIG. 26, outer wall 98 has a continuous straight or flat construction. In the embodiment according to FIG. 26, outer wall 98 is situated essentially perpendicular to a longitudinal axis of a pipe 120 of the first heat exchanger.

In the embodiment according to FIG. 27, outer wall 98 is concave.

FIG. 28 shows an embodiment in which outer wall 98 is convex.

In the exemplary embodiments according to FIGS. 26 to 28, rear wall 46 is oriented parallel to the longitudinal axis of a pipe 120 of first heat exchanger 10.

The embodiments that result from this can also be given in an embodiment according to FIG. 50, or according to FIGS. 1 to 3.

In these embodiments, base wall 24 is oriented essentially perpendicular to a longitudinal axis of a pipe 120 of the first heat exchanger.

In these embodiments, front wall 96 is oriented obliquely, or at an angle, to this longitudinal axis of a pipe 120 of first heat exchanger 10. In the embodiments according to FIGS. 26 to 28, rear wall 46, base wall 24, and front wall 96 are flat or straight.

The angle enclosed between the longitudinal axis of pipe 120 and the front wall is in particular as already described above.

Pipe 120 has been mentioned multiple times in connection with FIGS. 5 to 28. Such a pipe is to be understood as one of a plurality of pipes situated parallel to one another that run between the two collector pipes 14, 16 of the first heat exchanger.

The shape of the base wall described on the basis of FIGS. 5 and 6 can also be present in the embodiments according to FIGS. 7 to 28.

The shapes of rear wall 46 described on the basis of FIGS. 7 to 16 can also be present in the embodiment according to FIGS. 5 and 6, or 17 to 28.

The shapes of front wall 96 described on the basis of FIGS. 17 to 25 can also be present in the embodiments according to FIGS. 5 to 16, as well as 26 to 28.

The shapes of a front wall 98 described on the basis of FIGS. 26 to 28 can also be present in the embodiments according to FIGS. 5 to 25.

The cross-sectional shapes—regarded perpendicular to the longitudinal axis of collector pipe 14 of first heat exchanger 10—that have been described on the basis of or in connection with FIGS. 5 to 28 can in particular also be present in the embodiments described on the basis of FIGS. 1 to 3.

Various collector pipes of the first heat exchanger can be fashioned so as to be the same as or different from one another.

Embodiments in which base wall 24 is curved can, in a preferred embodiment, also be present in a radiator, independent of whether an air conditioning condenser is also present.

Strictly speaking, in such embodiments front wall 96 or rear wall 98 cannot be defined, as is done on the basis of FIG. 4, by the position of these walls relative to a collector pipe of a second heat exchanger or air conditioning condenser, because in the case depicted here an air conditioning condenser does not have to be present. For this case, let front wall 96 and rear wall 46 be defined as walls, situated opposite one another, of peripheral wall 50 that connect base wall 24 to outer wall 98.

FIGS. 29 to 35 show exemplary embodiments of the covering wall of a collector pipe 18 or 20 of a second heat exchanger 12, which is in particular an air conditioning condenser for a motor vehicle, in a cross-section that is essentially perpendicular to the longitudinal axis of this collector pipe 18 or 20.

In each of FIGS. 29 to 35, arrow 210 indicates the direction in which a second collector pipe 20 or 18, belonging to the same second heat exchanger 12, is situated. These collector pipes 20, 18 are, as already described, connected to one another in terms of flow via pipes 122 situated in parallel.

Collector pipes 18, 20 can be fashioned identically or differently. In particular, a collector 90 can be situated in at least one of these collector pipes 18, 20, in the form already described above.

In FIGS. 29, 30, 32, and 33, covering wall 212 of the collector pipe is fashioned—in the cross-section 10 shown there—with multiple parts, here two parts. In the embodiment according to FIG. 31, as well as FIGS. 34 and 35, this covering wall has a one-piece construction.

Two-piece covering walls 212 have a part 214 that faces the other collector pipe 20 of the second heat exchanger, as well as a part 216 that faces away from this pipe.

In each of the two-piece covering walls according to FIGS. 29, 30, 32, and 33, a segment 220 of part 214 is provided that overlaps with a segment 218 of part 216, as is a segment 222 of part 214 that overlaps with a segment 224 of part 212. These overlapping constructions are in each case fashioned such that these segments are situated adjacent to one another in the radial direction.

The overlapping segments are connected to one another, for example by soldering.

Figure 29:
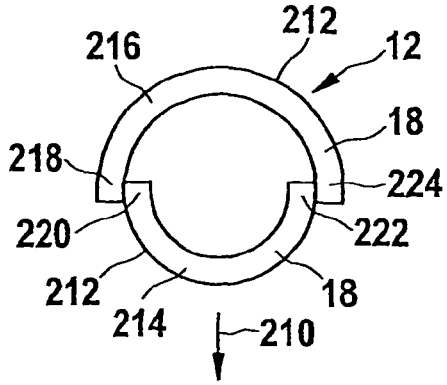
FIGS. 29 to 35 show exemplary cross-sections according to the present invention of the covering wall of a collector pipe of a second heat exchanger, situated perpendicular to the longitudinal axis of this collector pipe.
Figure 30:
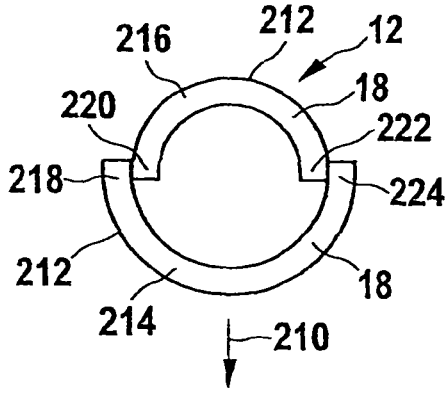

In FIGS. 29 and 30, covering wall 212 is approximately circular, seen in cross-section. In the embodiment according to FIG. 29, part 214 facing the other collector pipe of second heat exchanger 12 is inserted into part 216, which faces away from the other collector pipe.

In the embodiment according to FIG. 30, this is reversed, so that part 216 is inserted into part 214.

Figure 31:
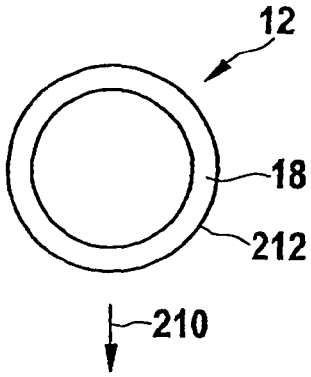

According to FIG. 31, covering wall 212, regarded in cross-section, has a one-piece, circular construction.

Figure 32:
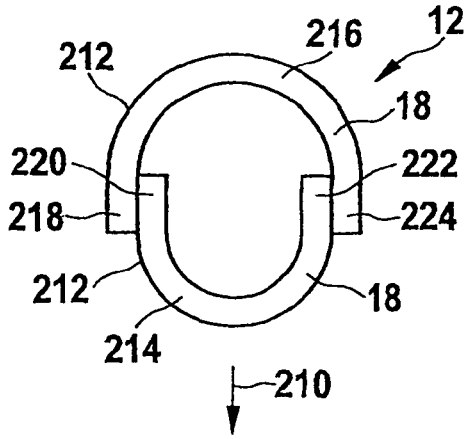
Figure 33:
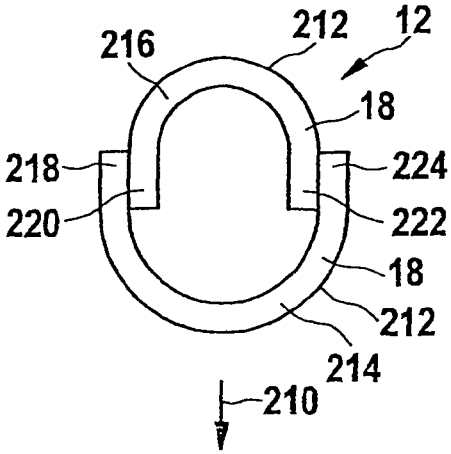

According to FIGS. 32 and 33, covering wall 212 is approximately oval in shape. According to these embodiments, segments 218, 220, 222, 224—i.e., those in which an overlapping is present—have a flat construction.

In the embodiment according to FIG. 32, part 214 facing the other collector pipe of second heat exchanger 12 is inserted into part 216, which faces away from this other collector pipe. In the embodiment according to FIG. 33, this is reversed, so that part 216 is inserted into part 214.

Figure 34:
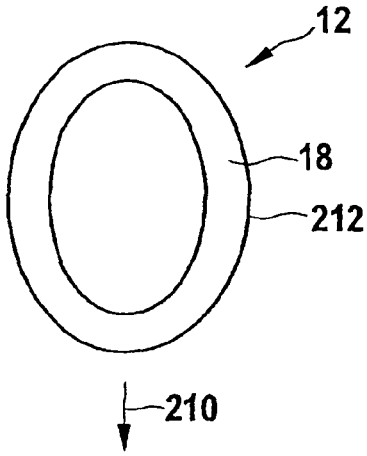
Figure 35:
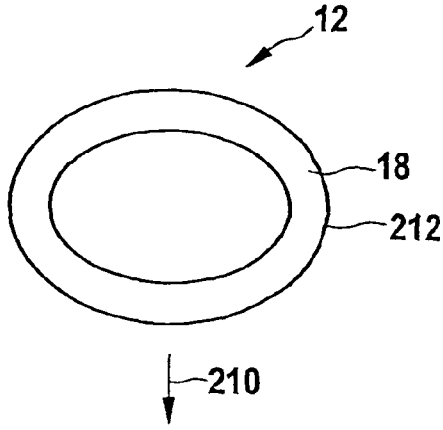

FIGS. 34 and 35 each show covering walls having an oval shape.

In the embodiment according to FIG. 34, the large main axis of elliptical or oval covering wall 212 is oriented essentially parallel to pipes 122.

In the embodiment according to FIG. 35, the small main axis of the oval or elliptically running covering wall is oriented essentially parallel to the longitudinal axis of a pipe 122.

In the embodiment described on the basis of FIGS. 1 to 3 and 50, collector pipes 18, 20 can (alternatively) in particular also be constructed as was described on the basis of FIGS. 29 to 35, or can have a correspondingly shaped covering wall 212.

In addition, such covering walls 212 can be present in a heat exchanger unit having a first heat exchanger 10 and a second heat exchanger 12 in which the first heat exchanger 10 has a collector pipe 14, 16 whose shape was described on the basis of, or in connection with, FIGS. 4 to 28.

On the basis of FIGS. 36 to 44, exemplary embodiments of the transitions, or transition areas, between walls 24, 96, 98, 46 of covering wall 50 or 52 of first heat exchanger 10 are now described.

In the embodiments according to FIGS. 1 to 28 and FIG. 50, these transitions or transition areas 100, 102, 104, and 106 can for example be as described on the basis of FIGS. 36 to 44.

Figure 36:
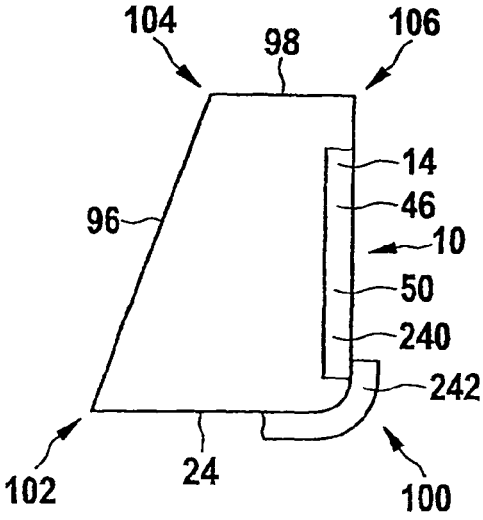
FIGS. 36 to 44 show exemplary cross-sections according to the present invention of the covering wall of a collector pipe of a first heat exchanger, perpendicular to the longitudinal axis of this collector pipe, as well as exemplary embodiments according to the present invention for transitions between walls of a collector pipe in a partial view.
Figure 37:
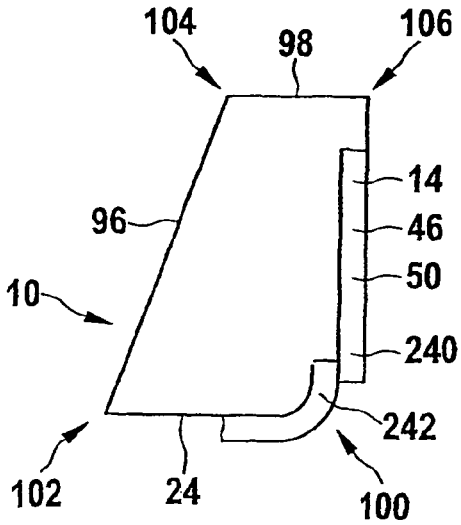
Figure 38:
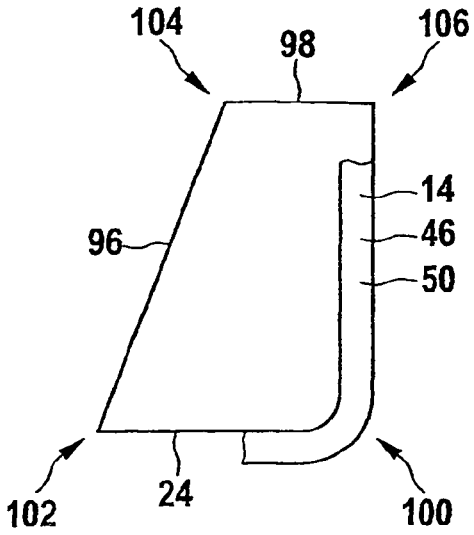

FIGS. 36 to 38 show examples of transitions between base wall 24 and rear wall 46.

In the embodiment according to FIGS. 36 and 37, a free end 242, which is a component of base wall 224 or is connected integrally therewith, is bent in such a way that it is oriented away from the other collector pipe 16 of the first heat exchanger. A free end 240 of rear wall 46 overlaps with free end 242.

These free ends 242, 240 are connected to one another, for example by soldering.

In the embodiment according to FIG. 36, free end 242 is situated on the outside of free end 240, and in the embodiment according to FIG. 37 free end 242 is situated on the inside of free end 240.

FIG. 38 shows an embodiment in which this transition between base wall 24 and rear wall 46 or transition area 100 is fashioned in a one-piece, rounded-off construction.

Figure 39:
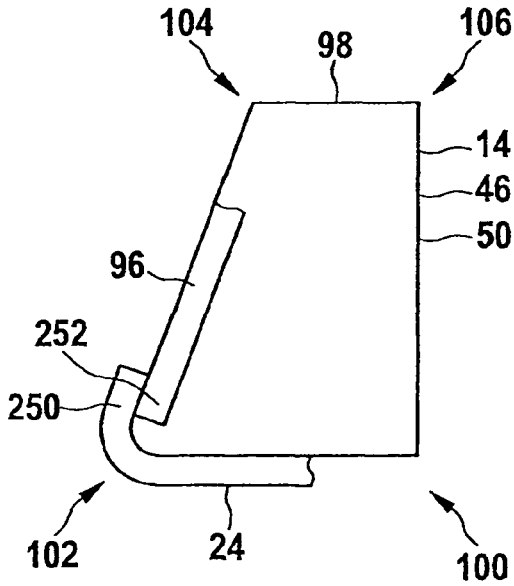
Figure 40:
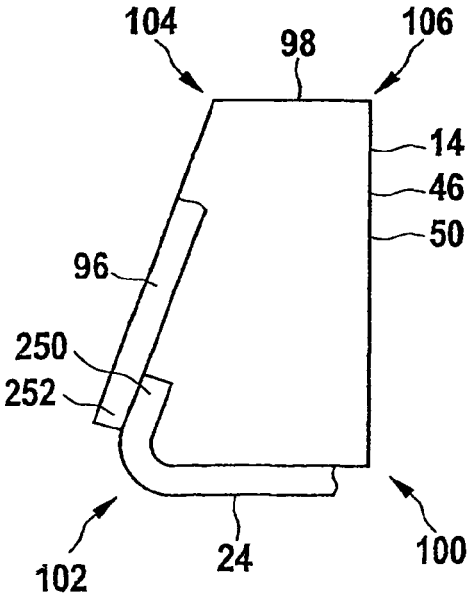
Figure 41:
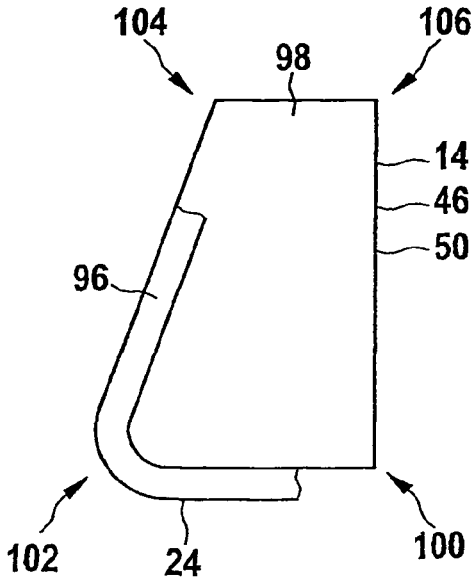

FIGS. 39 to 41 show exemplary transitions or transition areas 102 between base wall 24 and front wall 96.

In the embodiments according to FIG. 39 and FIG. 40, an end segment of the base wall, or an end segment of covering wall 50 connected integrally to this base wall 24, extends so as to be bent in the direction of front wall 96, and protrudes in the direction facing away from the other collector pipe of first heat exchanger 10. An end segment or free end 250 of this protruding area overlaps with an end segment 252 of front wall 96. In the embodiment according to FIG. 39, end segment 250 is situated on the outside of end segment 252, and in the embodiment according to FIG. 40 end segment 250 is situated on the inside of end segment 252. These end segments 250, 252 can be connected to one another, for example soldered to one another.

In the embodiment according to FIG. 41, base wall 24 is connected integrally to front wall 96, transition area 102 having a rounded-off construction.

Figure 42:
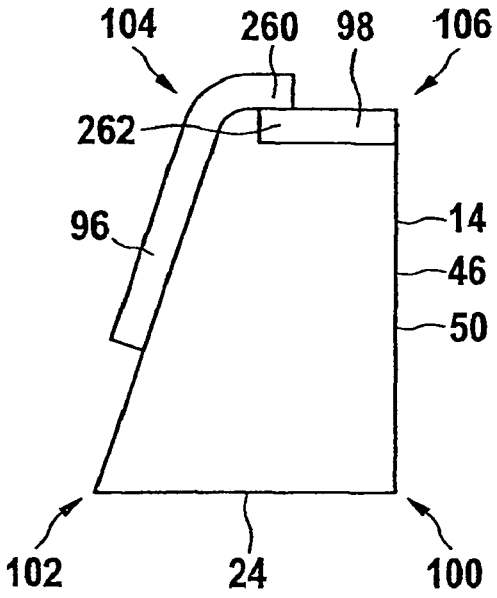
Figure 43:
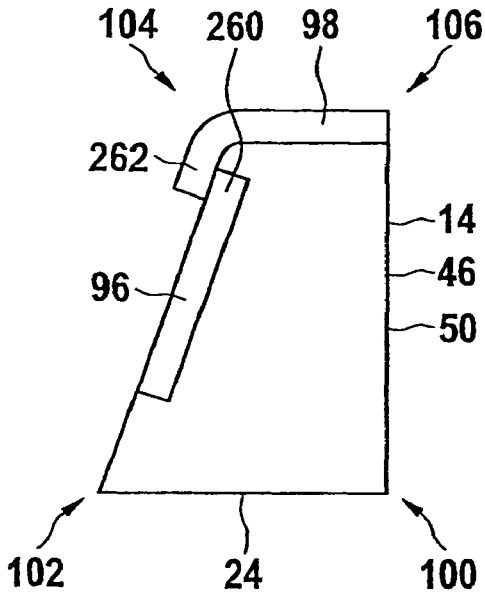
Figure 44:
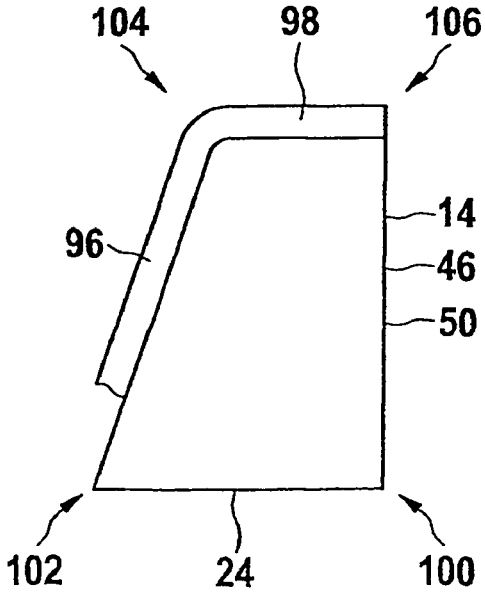

FIGS. 42 to 44 each show exemplary embodiments of transitions or transition areas 104 between front wall 96 and outer wall 98.

According to the embodiments shown in FIGS. 42 and 43, in this area two free ends 260, 262 of the peripheral wall are provided that overlap.

In the embodiment according to FIG. 42, this is realized in such a way that a free end 260 that extends in the direction of outer wall 98 or in the direction of rear wall 46 is provided that is a component of front wall 96 or is connected integrally with this front wall, and that extends in an angled-off manner from the rest of the course of this front wall 96. A free end 262 of outer wall 98 is situated in overlapping fashion on the inside of this free end 260.

In the embodiment according to FIG. 43, free end 260 is situated in overlapping fashion on the inside of free end 262. There, free end 262, which is integrally connected to outer wall 98 or is a component of this outer wall 98 and that extends essentially in the direction of front wall 96 or of base wall 24, is situated in overlapping fashion on the outside of free end 260. Free ends 260, 262 can be connected to one another, for example by soldering.

In the embodiment according to FIG. 44, transition area 104, or the transition between outer wall 98 and front wall 96, has a rounded-off, one-piece construction.

It is to be noted that the representations in FIGS. 36 to 44 each show cross-sections of collector pipe 14 or 16 of the first heat exchanger, these being cross-sections that are perpendicular to the longitudinal axis of this heat exchanger 10.

The transitions or transition areas shown in FIGS. 36 to 38 can for example also be combined with those shown in FIGS. 39 to 41 and/or those shown in FIGS. 42 to 44. The transitions or transition areas shown in FIGS. 39 to 41 can also be combined with those shown in FIGS. 42 to 44. The transitions or transition areas shown in FIGS. 36 to 44 or described on the basis of these Figures can in particular (alternatively) be present in the embodiments according to FIGS. 1 to 35 and 50.

FIG. 45 shows an exemplary specific embodiment of the present invention in a schematic partial view. In FIG. 45, in particular a covering wall of a collector pipe of a heat exchanger is shown. As an example, here a covering wall 50 of first heat exchanger 10 is shown. The course of this covering wall can be as shown in the Figure; however, it need not be realized in this manner, rather, it can also be shaped differently, in particular as was shown on the basis of the preceding Figures.

FIG. 45 shows that according to the present invention beads or reinforcements can be provided on covering wall 50 for the purpose of strengthening this wall.

FIG. 45 shows examples of beads 270, 272 situated on the inside of covering wall 50. In addition, exemplary beads 274 are shown that are situated on the outside of covering wall 50.

Such beads 270, 272, 274 can have various positions or locations.

They can be situated on one wall or can extend over different walls.

For example, such beads can be situated on the inside and/or outside of base wall 24 of a collector pipe of a heat exchanger. They can also be situated on front wall 96 or on rear wall 46 or on outer wall 98. In addition, they can extend over a plurality of the previously named walls.

It can also be provided that beads are stamped in.

Figure 46:
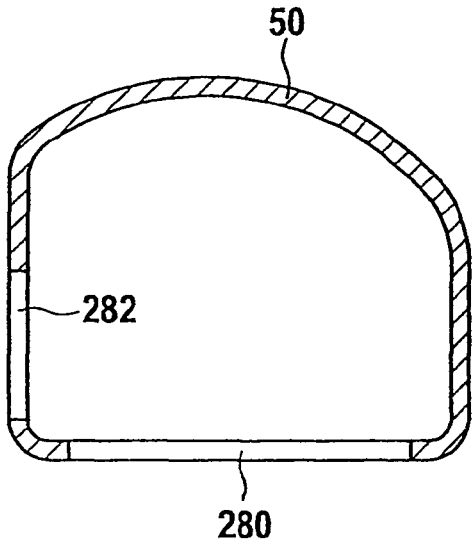
FIG. 46 shows an exemplary embodiment according to the present invention in a schematic partial view.

FIG. 46 shows an exemplary specific embodiment of the present invention in a schematic view.

As in FIG. 45, in FIG. 46 a cross-section of a collector pipe is shown that is situated perpendicular to the longitudinal axis of this collector pipe. The covering wall of the collector pipe shown in FIG. 46 is provided with reference character 50.

FIG. 46 is intended to illustrate that through-openings are provided at points, in particular different points, of covering wall 50. In the embodiment according to FIG. 46, a through-opening 280 and a through-opening 282 are provided.

Through-opening 280 is situated in particular in the base wall. A through-opening 282 can for example be situated in a front wall 96 or in a rear wall 46. A through-opening can also be situated in an outer wall 98.

Such through-openings can in particular be provided in order to receive pipes 120, 122, or in order to receive connecting collars, such as connecting collars 44. Pipes can be in particular (coolant) pipes 120. Such openings can also be provided for drainage devices or connecting pipes and the like.

Figure 47:
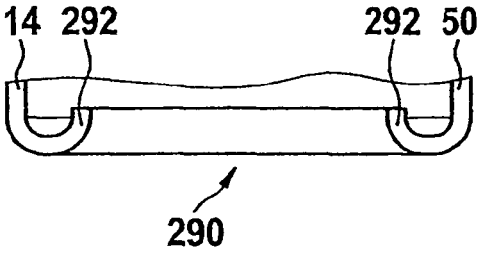
FIG. 47 shows an exemplary embodiment according to the present invention in a schematic partial view.
Figure 48:
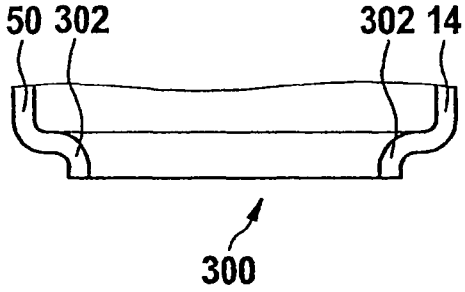
FIG. 48 shows an exemplary embodiment according to the present invention in a schematic partial view.
Figure 49:
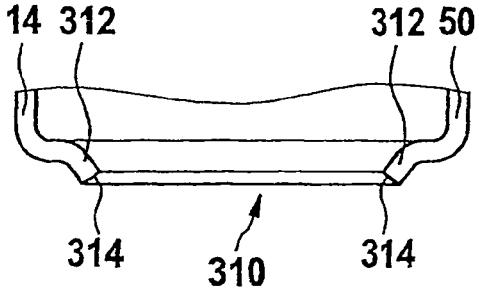
FIG. 49 shows an exemplary embodiment according to the present invention in a schematic partial view.

FIGS. 47 to 49 are intended to illustrate that according to the present invention differently shaped passages can be provided in a covering wall of a collector pipe of a heat exchanger, in particular in the covering wall of a collector pipe 14 or 16 of a first heat exchanger. Such passages can for example be provided in a base wall or in a front wall or in a rear wall or in an outer wall. They can be used in particular to receive pipes such as cooling pipes or connecting pipes or collars or drainage devices or the like.

In FIGS. 47 to 49, passages 290, 300, 310 are shown.

These passages are now explained in relation to the example of a collector pipe 14 of a first heat exchanger.

The passage shown in FIG. 47 is constructed such that free ends 292 are bent in the direction of the inside of the collector pipe.

Passage 300 in FIG. 48 is constructed such that free ends 302 of covering wall 50 of collector pipe 14 are bent outward, from the point of view of the inside of the collector pipe.

Passage 310 in FIG. 49 corresponds essentially to the passage in FIG. 48, the reference character 312 being used here in place of reference character 302, but differs in that introduction aids 314 are provided at the passage. Such introduction aids can be areas that are curved or chamfered or similarly constructed, situated in particular at the outer end of the passage, and intended to facilitate the introduction of pipes and the like.

The embodiments shown in FIGS. 45 to 49 and described on the basis of these Figures can also be provided in the embodiments according to FIGS. 1 to 44, as well as 50, in particular also in combination.

The invention claimed is:

1. A heat exchanger unit for motor vehicles comprising:

a first heat exchanger including two spaced collector pipes that are connected together in terms of flow, wherein a cross-section of a wall of one of the collector pipes of the first heat exchanger has a non-circular shape;

a second heat exchanger positioned adjacent to the first heat exchanger and including two spaced collector pipes, wherein the second heat exchanger is a condenser and a cross-section of a wall of at least one of the collector pipes of the second heat exchanger is one of oval, elliptical, or circular in shape, and wherein a front wall of at least one of the collector pipes of the first heat exchanger faces an adjacent collector pipe of the second heat exchanger, the front wall having a continuously convex cross-section, a first one of the collector pipes of the first heat exchanger being positioned adjacent to one of the collector pipes of the second heat exchanger, and a second one of the collector pipes of the first heat exchanger being positioned adjacent to the other collector pipe of the second heat exchanger, and a collector connected to one of the collector pipes of the second heat exchanger.

2. The heat exchanger unit of claim 1, wherein a cross-section of a wall of at least one of the collector pipes of one of the first heat exchanger and the second heat exchanger includes overlapping segments.

3. The heat exchanger unit of claim 1, wherein the first heat exchanger is a radiator, wherein a wall of at least one of the collector pipes of the first heat exchanger is non-circular in shape, and faces the other collector pipe of the first heat exchanger, another wall of the collector pipe of the first heat exchanger being a floor wall, wherein the floor wall of includes a curved segment.

4. The heat exchanger unit of claim 1, wherein the first heat exchanger is a radiator and the second heat exchanger is an air-conditioner condenser.

5. The heat exchanger unit of claim 1, wherein at least one of the collector pipes of the first heat exchanger is limited by a floor wall that faces the other collector pipe of this first heat exchanger, an outer wall that faces away from the other collector pipe of the first heat exchanger, a front wall that faces the adjacent collector pipe of the second heat exchanger, and a rear wall that faces away from the adjacent collector pipe of the second heat exchanger.

6. The heat exchanger unit according to claim 5, wherein the rear wall and the outer wall each have a flat construction, and are oriented perpendicular to one another, the rear wall being oriented parallel to pipes that produce a flow connection between the two collector pipes of the first heat exchanger.

7. The heat exchanger unit of claim 1, wherein at least one segment of the wall of one of the collector pipes of the first heat exchanger is concavely curved.

8. The heat exchanger unit of claim 1, wherein at least one segment of the wall of one of the collector pipes of the first heat exchanger is convexly curved.

9. The heat exchanger unit according to claim 8, wherein a wall of a collector pipe of the first heat exchanger has adjacent segments that are straight and that define an angle between 95° and 175°.

10. The heat exchanger unit according to claim 9, wherein the front wall has at least two adjacent straight segments that define an angle between 95° and 175°.

11. The heat exchanger unit according to claim 8, wherein the convexly curved segment is curved in such a way that various radii of curvature (R) are present in the convexly curved segment.

12. The heat exchanger unit according to claim 8, wherein the convexly curved segment is curved in such a way that the segment length ($s_{total}$) of the convexly curved segment is less than ($0.5*x*\pi$) times the radius of curvature (R) of this segment, x being greater than zero and less than 0.8.

13. The heat exchanger unit according to claim 8, wherein the convexly curved segment is curved in such a way that along the segment length ($s_{total}$) of this convexly curved segment, various radii of curvature (R) are provided, the segment length ($s_{total}$) being less than ($0.5*x*\pi$) times a minimum radius of curvature ($R_{minimum}$) of these radii of curvature (R), and x being greater than zero and less than 0.8.

14. The heat exchanger unit according to claim 8, wherein the convexly curved segment is curved in such a way that along the segment length ($s_{total}$) of this convexly curved segment, various radii of curvature are provided, the segment length ($s_{total}$) being less than ($0.5*x*\pi$) times the mean radius of curvature ($R_{mean}$) of the segment, x being greater than zero and less than 0.8, and the mean radius of curvature ($R_{mean}$) corresponding to the quotient of an integral and the (segment) length ($s_{total}$), this integral being the integral of ($s*R(s)$)ds within the limits s=0 and $s=s_{total}$, s being the path running along the convexly curved segment and R(s) being the radius of curvature at a particular position along this path.

15. The heat exchanger unit according to claim 8, wherein the floor wall includes said convexly curved segment.

16. The heat exchanger unit according to claim 8, wherein at least one of the collector pipes and the entire heat exchanger unit are made of aluminum.

17. The heat exchanger unit according to claim 1, wall of one of the collector pipes of the first heat exchanger has adjacent segments that are straight and define an angle between 95° and 175°.

18. A heat exchanger unit for motor vehicles comprising:

a first heat exchanger including two spaced collector pipes that are connected together in terms of flow, wherein a cross-section of one of the collector pipes of the first heat exchanger has a non-circular shape;

a second heat exchanger positioned adjacent to the first heat exchanger and including two spaced collector pipes that are connected together in terms of flow, wherein the second heat exchanger is a condenser, and wherein a cross-section of a wall of at least one of the collector pipes of the second heat exchanger is one of oval, elliptical, or circular in shape, a first one of the collector pipes of the first heat exchanger being adjacent to one of the collector pipes of the second heat exchanger, and a second one of the collector pipes of the first heat exchanger being adjacent to the other collector pipe of the second heat exchanger, and a front wall of at least one of the collector pipes of the first heat exchanger facing an adjacent one of the collector pipes of the second heat exchanger, wherein the front wall has a continuously concave segment, and a collector connected to one of the collector pipes of the second heat exchanger.

19. The heat exchanger unit according to claim 18, wherein at least one of the collector pipes and the entire heat exchanger unit are made of aluminum.

20. A heat exchanger unit for motor vehicles comprising: a first heat exchanger including two spaced collector pipes that are connected together in terms of flow, wherein a cross-section of one of the collector pipes of the first heat exchanger has a non-circular shape; and a second heat exchanger positioned adjacent to the first heat exchanger and including two spaced collector pipes that are connected together in terms of flow, wherein the second heat exchanger is a condenser, and wherein a cross-section of a wall of at least one of the collector pipes of the second heat exchanger is one of oval, elliptical, or circular in shape, a first one of the collector pipes of the first heat exchanger being adjacent to one of the collector pipes of the second heat exchanger, and a second one of the collector pipes of the first heat exchanger being adjacent to the other collector pipe of the second heat exchanger, wherein a front wall of at least one of the collector pipes of the first heat exchanger faces an adjacent one of the collector pipes of the second heat exchanger, the front wall having a convex segment and a concave segment, and a collector connected to one of the collector pipes of the second heat exchanger.

21. A heat exchanger unit for motor vehicles, comprising:

a first heat exchanger including two spaced collector pipes that are connected together in terms of flow, wherein a cross-section of one of the collector pipes of the first heat exchanger has a non-circular shape; and a second heat exchanger positioned adjacent to the first heat exchanger and including two spaced collector pipes that are connected together in terms of flow, wherein the second heat exchanger is a condenser, and wherein a cross-section of a wall of at least one of the collector pipes of the second heat exchanger is one of oval, elliptical, or circular in shape, a first one of the collector pipes of the first heat exchanger being adjacent to one of the collector pipes of the second heat exchanger, and a second one of the collector pipes of the first heat exchanger being adjacent to the other collector pipe of the second heat exchanger, and a front wall of at least one of the collector pipes of the first heat exchanger facing an adjacent one of the collector pipes of the second heat exchanger, the front wall having a straight segment, and positioned at an incline relative to the collector pipes of this first heat exchanger; and a heat exchanger block having a plurality of parallel pipes provided between the collector pipes of each of the first and second heat exchangers.

22. A heat exchanger unit for motor vehicles, comprising:

a first heat exchanger including two spaced collector pipes that are connected together in terms of flow, wherein a cross-section of one of the collector pipes of the first heat exchanger has a non-circular shape; and a second heat exchanger positioned adjacent to the first heat exchanger and including two spaced collector pipes that are connected together in terms of flow, wherein the second heat exchanger is a condenser, and wherein a cross-section of a wall of at least one of the collector pipes of the second heat exchanger is one of oval, elliptical, or circular in shape, a first one of the collector pipes of the first heat exchanger being adjacent to one of the collector pipes of the second heat exchanger, and a second one of the collector pipes of the first heat exchanger being adjacent to the other collector pipe of the second heat exchanger, and a front wall of at least one of the collector pipes of the first heat exchanger facing an adjacent collector pipe of the second heat exchanger, the front wall having straight segments, which are positioned at an angle relative to a longitudinal axis of one of the collector pipes of the first heat exchanger, the front wall and the longitudinal axis forming an angle between 95° and 175° a collector connected to one of the collector pipes of the second heat exchanger; and a heat exchanger block having a plurality of parallel pipes provided between the collector pipes of each of the first and second heat exchangers.

* * * * *